US010443200B2

(12) United States Patent
Van Grieken et al.

(10) Patent No.: US 10,443,200 B2
(45) Date of Patent: Oct. 15, 2019

(54) LIFTING DEVICE FOR LIFTING AN UPPER PART OF A SEA PLATFORM

(71) Applicant: Heerema Marine Contractors Nederland SE, Leiden (NL)

(72) Inventors: Gerardus Cornelius Van Grieken, Leiden (NL); Timotheus Johannes Rutten, Leiden (NL)

(73) Assignee: Heerema Marine Contractors Nederland SE, Leiden (NL)

( * ) Notice: Subject to any disclaimer, the term of this patent is extended or adjusted under 35 U.S.C. 154(b) by 111 days.

(21) Appl. No.: 15/514,418

(22) PCT Filed: Sep. 28, 2015

(86) PCT No.: PCT/NL2015/050672

§ 371 (c)(1),
(2) Date: Mar. 24, 2017

(87) PCT Pub. No.: WO2016/048156

PCT Pub. Date: Mar. 31, 2016

(65) Prior Publication Data

US 2017/0241096 A1 Aug. 24, 2017

(30) Foreign Application Priority Data

Sep. 26, 2014 (NL) ..... 2013539
Feb. 19, 2015 (NL) ..... 2014315

(51) Int. Cl.
*E02B 17/08* (2006.01)
*B63B 35/00* (2006.01)
(Continued)

(52) U.S. Cl.
CPC ..... *E02B 17/0809* (2013.01); *B63B 9/065* (2013.01); *B63B 35/003* (2013.01);
(Continued)

(58) Field of Classification Search
CPC ..... E02B 17/00; E02B 17/08; E02B 17/0809; E02B 2017/0039; E02B 2017/0047;
(Continued)

(56) References Cited

U.S. PATENT DOCUMENTS 4,065,934 A * 1/1978 Dysarz ..... E02B 17/021 114/258
5,829,919 A * 11/1998 Heerema ..... B63B 35/003 405/209

(Continued)

FOREIGN PATENT DOCUMENTS

GB 2306407 A 5/1997
GB 2363814 A 1/2002

(Continued)

OTHER PUBLICATIONS

International Search Report and Written Opinion dated Feb. 17, 2016 for Application No. PCT/NL2015/050672.

(Continued)

*Primary Examiner* — Benjamin F Fiorello
*Assistant Examiner* — Stacy N Lawson
(74) *Attorney, Agent, or Firm* — Patterson + Sheridan, LLP

(57) ABSTRACT

The present invention relates to a lifting device for lifting an upper part of a sea platform, the sea platform comprising a support structure and a top side, the lifting device being constructed to be positioned on a lifting vessel, the lifting device comprising: a base frame constructed to rest on the lifting vessel, at least one console frame connected to the base frame via a flexible connection system, a suspension system connected to the console frame and comprising a leg connector, wherein the suspension system is constructed to allow freedom of movement of the leg connector relative to the console frame, wherein the flexible connection system (Continued)

forms a flexible connection between the console frame and the base frame and allows a predetermined movement of the console frame.

19 Claims, 21 Drawing Sheets

(51) Int. Cl.
*B63B 9/06* (2006.01)
*E02B 17/00* (2006.01)

(52) U.S. Cl.
CPC ..... *E02B 17/00* (2013.01); *E02B 2017/0039* (2013.01); *E02B 2017/0047* (2013.01); *E02B 2017/0052* (2013.01)

(58) Field of Classification Search
CPC ..... E02B 2017/0052; B63B 35/003; B63B 9/065; B63B 27/30
See application file for complete search history.

(56) References Cited

U.S. PATENT DOCUMENTS 6,550,411 B1 * 4/2003 Den Hartogh ..... B63B 35/003 114/258
6,668,746 B1 * 12/2003 Schia ..... B63B 9/065 114/264
2004/0025777 A1 * 2/2004 Werners ..... B63B 27/02 114/362
2004/0037650 A1 * 2/2004 Steenhuis ..... B63B 35/003 405/202
2005/0095069 A1 * 5/2005 Johansson ..... B63B 9/065 405/204
2012/0282064 A1 * 11/2012 Payne ..... B63B 27/10 414/139.6

FOREIGN PATENT DOCUMENTS

WO 0172582 A1 10/2001
WO 03066425 A1 8/2003
WO 2015012695 A1 1/2015

OTHER PUBLICATIONS

Search Report and Written Opinion dated Apr. 30, 2015 for Netherland Application No. NL2013539.

* cited by examiner

A - A

LIFTING DEVICE FOR LIFTING AN UPPER PART OF A SEA PLATFORM

This patent application claims priority from the Dutch application No. 2013539, filed in the Netherlands on 26 Sep. 2014 and Dutch application No. 2014315, filed in the Netherlands on 19 Feb. 2015. The contents of these two documents are incorporated by reference herein in their entirety as a part of this document.

FIELD OF THE INVENTION

The present invention relates to a lifting device for lifting a sea platform, in particular an upper part of a sea platform. The present invention relates to a lifting vessel comprising the lifting device and to a method of lifting a sea platform, in particular an upper part of a sea platform.

BACKGROUND OF THE INVENTION

The transport of large parts of a sea platform, such as a support structure or a top side as a whole, is required during both the removal and installation thereof. There is a desire to transport the topside or supporting structure as a complete part to limit offshore installation work.

Typically, existing sea platforms have a certain economical or technical life span after which they need to be removed. The removal generally comprises a lift operation and a transport operation.

In this document, the term "lifting operation" comprises all operations before the actual lift off of the part of the sea platform to be removed, e.g. engagement of the clamping system and the load transfer until the lift off, and the lift off procedure itself. The term "transport operation" comprises the operations which start after the lift off of the upper part has finished, i.e. after the upper part of the sea platform is lifted from the lower part and supported by the lifting vessel.

The lift operation is a complex and expensive operation for several reasons. One reason is the shear size and weight of sea platforms. Only very large lifting vessels are capable of lifting such a platform in a single lift or in a limited number of lifts.

Another reason is the fact that a lifting vessel moves under influence of waves, wind and current. The sea platform generally is stationary or substantially stationary, because it rests on the sea bottom or is limited in its motions in another way. The lifting vessel therefore moves with respect to the sea platform which makes it difficult to connect to the sea platform and to carry out the lifting operation. There generally is a risk of collision between the lifting vessel and the sea platform.

It was recognized in the present invention that it is beneficial to have the capability of switching between a mode having a low vertical stiffness to a mode having a high 10 vertical stiffness because during the lifting operation there needs to be more relative freedom of movement than in the subsequent transport operation. It was recognized that this switching between modes should be very reliable and as simple as possible.

A number of heavy lift systems have been developed so far. One known concept is to use large cranes on a semi-submersible vessel. This solution is known from existing heavy lift vessels such as Hermod, Balder and Thialf. These vessels can lift an upper part of a sea platform from a lower part and subsequently place the upper part on a barge. It was found that this is a rather complex operation which requires calm weather. The lift capacity is also limited.

Another concept is disclosed in US2013/0045056. A lifting vessel has two arms and a number of lifting devices on these arms. It was recognized in the present invention that the lifting device of US2013/0045056 allows only a limited freedom of movement of the lifting vessel relative to the sea platform. This narrows a window of opportunity in which the weather is sufficiently calm for the operation to be carried out in many locations.

Further, known lifting systems rely on an accurately pre-calculated centre of gravity (COG) of the sea platform. If during the lift operation the position of the COG is found to be different than expected or calculated on the basis of the available data, a compensation system is required to cope with the difference in load distribution between the connection points.

Another lifting vessel system is being developed under the name Pioneering Spirit by the company Allseas, a description of which can be found on www.allseas.com. It was recognized in the present invention that this system requires large actuators to compensate for the relative movements between the sea platform and the lifting vessel. The large actuators are complex and require much maintenance. Moreover, during the actual lifting operation the actuators are actively controlled which requires much energy to keep the movements of the sea platform within the prescribed limits.

A variant of the system of Pioneering Spirit is disclosed in GB2306407 in the name of Allseas Group. This concept is not capable of switching between a mode having a low vertical stiffness to a mode having a high vertical stiffness. Furthermore, the connectors of GB2306407 which connect to the topside are simple abutment faces. This is a rather primitive concept. It was recognized in the present invention that connectors which can slide relative to leg parts of the structure are more advanced.

Another lifting concept is disclosed in WO0172582 in the name of Excalibur Engineering B.V. This concept is also not capable of switching between a mode having a low vertical stiffness to a mode having a high vertical stiffness.

A further concept is published on 29 Jan. 2015 in WO2015/012695 in the name of Heerema Marine Contractors. This concept is rather complex and requires a cumbersome transition from a mode having a low vertical stiffness to a mode having a high vertical stiffness. Furthermore, this system results in high tensions or excessive relative movements during transport.

A further concept is disclosed in GB2363814 in the name of Marine Shuttle Operations AS. Like WO0172582, this concept does not provide the capability of switching between a mode having a low vertical stiffness to a mode having a high vertical stiffness. Furthermore, this concept engages the topside directly, instead of engaging leg parts underneath the topside. This is very disadvantageous.

OBJECT OF THE INVENTION

It is an object of the invention to provide an alternative lifting device, lifting method and a lifting vessel comprising such a lifting device.

It is another object of the invention to provide a relatively simple lifting device, lifting method and a lifting vessel comprising such a lifting device.

It is another object of the invention to provide a lifting device which combines safety with a possibility to vary the stiffness between the lifting vessel and the sea platform during the lifting operation.

It is another object of the invention to provide a lifting device which provides freedom of movement between the sea platform and the lifting vessel during a lifting operation and provides a relatively stiff but not entirely rigid connection between the sea platform and the lifting vessel during a transport operation.

It is another object of the invention to provide a lifting device, lifting method and lifting vessel which requires less energy for maintaining a position of the upper part of the sea platform during lift and subsequent transport, in particular by using passive control where possible.

THE INVENTION

In order to achieve at least one of the objectives, the invention provides a lifting device for lifting a sea platform, in particular an upper part of a sea platform, the sea platform comprising a support structure and a top side, the lifting device being constructed to be positioned on a lifting vessel, the lifting device comprising:

a base frame constructed to rest on the lifting vessel, at least one console frame connected to the base frame via a flexible connection system, a suspension system connected to the console frame or to the base frame and comprising a leg connector which is constructed to be connected to a leg of the sea platform, wherein the suspension system is constructed to allow freedom of movement of the leg connector relative to the console frame, wherein the flexible connection system forms a flexible connection between the console frame and the base frame and allows a predetermined movement of the console frame relative to the base frame, wherein the suspension system comprises at least one pivotable beam which extends outwardly away from the base frame over a horizontal distance and is pivotable about a horizontal pivot axis relative to the base frame, wherein the lifting device comprises a pivotable beam actuator for pivoting the pivotable beam between an upper position and a lower position, and wherein the lifting device is constructed to be switched from a:

free-moving mode in which the console frame, the flexible connection system and the pivotable beam actuator provide a low stiffness and a low counterforce against a downward pivotal movement of the pivotable beam, to a supporting mode in which the console frame and the flexible connection system provide a high stiffness and a high counterforce against said downward pivotal movement of the pivotable beam.

Advantageously, the lifting device allows some horizontal and vertical freedom of movement between the sea platform and the lifting vessel during a lifting operation while creating a relatively stiff but not entirely rigid vertical connection between the sea platform and the lifting vessel during a transport operation.

The device according to the invention is relatively simple and reliable in operation. The free-moving mode will be used during a load transfer operation, which is a part of the lifting operation. During the load transfer operation the weight of the upper part of the sea platform is gradually transferred to the lifting vessel. The free-moving mode allows the lifting vessel to move relative to the upper part of the sea platform. The supporting mode will be used during transport. The upper part of the sea platform is secured to the lifting vessel via the lifting devices, but a small relative movement remains possible to reduce forces of the upper part of the sea platform on the lifting arms.

In an embodiment, the console frame extends outwardly away from the base frame and is pivotable about a horizontal pivot axis relative to the base frame, wherein in the supporting mode the console frame supports the pivotable beam at an outer support at a horizontal distance from the base frame. This embodiment provides very strong and reliable mechanism for supporting the suspension system.

In an embodiment, in the free-moving mode the pivotable beam actuator is active and wherein in the supporting mode the pivotable beam actuator is inactive. By deactivating the pivotable beam actuator, the stiffness of the lifting device increase, because the flexible connection system then determines the overall stiffness.

In an embodiment, the suspension system comprises at least one pendulum arm being connected at an upper end thereof to a protruding end of the pivotable beam via a pendulum hinge, wherein the leg connector is attached to a lower end of the at least one pendulum arm via a leg connector hinge, and wherein the suspension system is constructed to allow freedom of movement of the leg connector relative to the pivotable beam. The pendulum arm and the hinges provide a horizontal freedom of movement of the lifting vessel relative to the sea platform.

In an embodiment, in the lower position the pivotable beam engages the outer support of the console frame and is supported by the console frame, and in the upper position the pivotable beam is positioned at a distance above the outer support and is allowed to pivot over an angle $\beta$, wherein in the upper position the lifting device is in the free-moving mode, wherein in the lower position the lifting device is in the supporting mode, and wherein the lifting device is configured to be switched from the free-moving mode to the supporting mode by pivoting the pivotable beam downward and engaging the outer support of the console frame. It was found that this embodiment is very strong and reliable.

In an embodiment:

in the free-moving mode the pivotable beam actuator holds the pivotable beam in the upper position and provides a relatively low stiffness against a downward pivotal movement of the pivotable beam, and in the supporting mode the console frame and the flexible connection system support the pivotable beam at a support position against a downward pivotal movement and provide a counterforce against the downward pivotal movement of the pivotable beam, the flexible connection system having a relatively high stiffness in comparison with the relatively low stiffness of the pivotable beam actuator and allowing a limited movement of the pivotable beam together with the console frame relative to the base frame.

In an embodiment, in the upper position of the pivotable beam a vertical stiffness of the leg connector relative to the base frame is determined by the pivotable beam actuator or by the pivotable beam actuator together with the flexible connection system.

The vertical stiffness of the leg connector is defined as the vertical displacement of the leg connector relative to the base frame as a result of a vertical force acting on the leg connector.

In an embodiment, the flexible connection system comprises an actuation system which extends between the base frame and the console frame and which is configured to exert a force on the console frame, wherein the force is adjustable in order to vary the load-displacement relationship of the flexible connection system.

With the actuation system, the stiffness of the flexible connection system can be tuned, even during a lifting operation.

In an embodiment, the flexible connection system comprises resilient members which allow the console frame to be displaced relative to the base frame over a limited angle by deformation of the resilient members.

The resilient members allow the sea platform to be lifted in a passive mode, without applying external energy during the lift.

In an embodiment, the resilient members are configured to deform under shear stress.

In an embodiment, a load-displacement relationship between the base frame and the console frame as defined by the flexible connection system is adjustable:

by varying the number and/or position of the resilient members, and by adjusting the actuation system.

This provides a combined advantage of a passive system which can also be easily tuned, even during the lifting operation.

In an embodiment, the resilient members and the actuation system act in parallel on the console frame, and wherein the actuation system is configured to apply an adjustable force on the console frame when the console frame is in a neutral position in which the resilient members are not under tension.

In an embodiment, the resilient members and the actuation system act in parallel on the console frame, and wherein the actuation system is configured to have an adjustable stiffness range.

In an embodiment, the actuation system comprises at least one cylinder, in particular a hydraulic cylinder, and a pump to control a pressure in the cylinder. This provides the benefit of an effective and simple adjusting capability of the stiffness of the actuation system.

In an embodiment, the actuation system comprises at least one accumulator configured to let the cylinder act as a spring. This allows the flexible connection system to be used in a passive mode, i.e. both the resilient members and the actuation system can be operated passively, without applying external energy.

In an embodiment, the force exerted by the actuation system on the console frame is dependent on the displacement of the console frame relative to the base frame.

In an embodiment, the flexible connection system further comprises connection beams, wherein the base frame comprises deck beams, and wherein the resilient members are positioned between the connection beams and the deck beams and interconnect the connection beams and the deck beams. This was found to be a simple arrangement.

In an embodiment, the connection beams extend parallel to the deck beams of a deck part of the base frame.

In an embodiment, the flexible connection system acts on the deck part of the base frame and on an upper part of the console frame. The upper part of the console frame may extend to above the deck of the lifting vessel and may be easy to connect to for the flexible connection system In an embodiment, the lifting device comprises a horizontal restraining system for limiting a horizontal movement of the legs, wherein the suspension system is configured to exert a vertical force on the legs via the leg connector, and wherein the horizontal restraining system is configured to exert a horizontal force on the leg. The horizontal restraining system is separate from the horizontal beam and forms a separate connection between the base frame and the leg. The horizontal restraining system allows decoupling of the horizontal and vertical components of the forces on the legs. The vertical forces are applied via the suspension system and the leg connectors and the horizontal forces are applied to the legs via a different route. If a number of lifting devices are positioned on a lifting vessel, only one or two or for instance half of the total number of lifting devices need to have a horizontal restraining system. The other lifting devices can do without. Therefore, the lifting vessel may comprise a number of lifting devices without a horizontal restraining system and a number of lifting devices with a horizontal restraining system.

In an embodiment, the horizontal restraining system comprises at least two horizontal restrainers which are constructed to limit the horizontal movement of the leg in an X-direction and an Y-direction, wherein the X-direction is a longitudinal direction of a lifting vessel and the Y-direction is the transverse direction of the lifting vessel. This is an effective way of restraining the horizontal movements along both the X-axis and the Y-axis. The at least two horizontal restrainers may be connected at one end to respective restraining support positions on the base frame and may be configured to be connected at an opposite end to the leg, directly or indirectly via a collar which is attached to the leg or indirectly via the leg connector.

In an embodiment, the horizontal restrainers are positioned substantially at a vertical distance above the leg connector, in particular above a deck part of the base frame, and are directed at a part of the leg which is substantially closer to the top side of the sea platform than a part of the leg on which the leg connector acts, and wherein said vertical distance is in particular greater than 2 meter. This effectively limits the bending moments in the legs and prevents damage to the legs.

In an embodiment, in top view the horizontal restrainers extend at an angle $\alpha$ of between 70 and 110 degrees relative to one another.

In an embodiment, the horizontal restrainers comprise hydraulic cylinders. In an embodiment, each horizontal restrainer is configured to act as a spring, in particular with an adjustable spring constant (or stiffness). This allows tuning of the horizontal restrainers according to specific requirements in an effective way.

In an embodiment, a load-displacement relationship of the horizontal restrainers is adjustable, in particular independently for each of the two horizontal restrainers.

In an embodiment, the horizontal restrainers are configured to operate in a passive mode without applying external energy.

In an embodiment, distal ends of the horizontal restrainers are positioned higher than a deck part of the base frame and wherein the leg connector is positioned lower than the deck part.

In an embodiment, the suspension system and the horizontal restraining system are constructed to substantially prevent horizontal forces to be exerted onto the legs via the suspension system. This prevents large bending moments in the leg.

In an embodiment, the at least two horizontal restrainers are connected at one end to respective restraining support positions on the base frame and are configured to be connected at an opposite end to the leg, directly or indirectly via a collar which is attached to the leg.

In an embodiment, horizontal restrainers are used at only one of the two lifting arms of the installation vessel. This allows for a statically determined overall system.

In an embodiment, the base frame defines a number of pivot points, and wherein the console frame is connected to the base frame via the pivot points in order to make a pivoting movement about a pivot axis defined by the pivot points relative to the base frame. The pivoting movement was found to be a very practical way of allowing some relative movement between the lifted upper part of the sea platform and the lifting vessel.

In an embodiment, the console frame comprises a console having an outer support, the console frame further comprising at least one upper connection point on which the flexible connection system acts.

In an embodiment, the suspension system comprises:

- at least one pivotable beam connected to the console frame or the base frame via a hinging connection which allows the pivotable beam to pivot relative to the console frame between a lower position and an upper position, wherein in the lower position the pivotable beam engages the outer support of the console and is supported by the console frame, and wherein in the upper position the pivotable beam is positioned at a distance above the outer support and is allowed to pivot over an angle β,
- a pivotable beam actuator for pivoting the pivotable beam between the upper position and the lower position, and
- at least one pendulum arm connected at an upper end thereof to a protruding end of the pivotable beam via a pendulum hinge,
- the at least one leg connector constructed to be connected to the leg, wherein the at least one leg connector is attached to a lower end of the at least one pendulum arm via a leg connector hinge.

The pendulum arms offer a natural relative movement between the lifting vessel and the upper part of the sea platform, in particular during the stage in which the lifting vessel is connected to the sea platform but has not lifted the upper part of the sea platform yet.

In an embodiment, the base frame has a deck part and a side part which extends downwards from the deck part, wherein the pivot points are provided on the side part and located lower than the deck part. In an embodiment, the deck part comprises the deck beams.

In an embodiment, the base frame has a deck part and a side part, wherein the flexible connection system comprises one or more cylinders, in particular one or more hydraulic cylinders, which are located below the console frame and extend between a lower pivot point on the side part to an upper pivot point on the console frame.

In an embodiment, the pivot points via which the console frame is connected to the base frame are provided on the side part of the base frame and above the lower pivot points to which the one or more cylinders of the flexible connection system are connected, and wherein in particular the pivot points are located at a horizontal level which lies between the horizontal level of the pendulum hinge and the horizontal level of the leg connector hinge.

In an embodiment, the lifting device comprises two console frames and two pivotable beams, wherein each console frame is configured to support an associated pivotable beam via its outer support, and wherein each pivotable beam supports a pendulum arm, wherein the leg connector is supported on each side by the lower end of a pendulum arm.

In an embodiment, the at least one pendulum hinge between the pendulum arms and the pivotable beams and the at least one leg connector hinge between the at least one pendulum arm and the at least one leg connector are gimbal hinges which allow rotation about three independent axis of the pendulum arms relative to pivotable beams and of the leg connectors relative to the pendulum arms.

In an embodiment, the base frame is configured to be positioned on a lifting arm of a lifting vessel, wherein the pivot points are positioned at a distance below the deck part and wherein in particular the deck part and the side part extend at an angle of 90 degrees relative to one another.

In an embodiment, the console extends outwardly from the base frame over a horizontal distance.

In an embodiment, the leg connectors have an abutment surface at an upper side thereof and are constructed to slide relative to the legs in order to exert a vertical force onto the legs, in particular via the abutment surface and via a collar which is attached to the leg above a position where the leg connectors are engaged with the leg.

In an embodiment, the pivotable beams pivot about a horizontal axis, and wherein the console frame pivots about a horizontal pivot axis.

In an embodiment, the lifting device can be switched between a:

- a free-moving mode, in which the at least one pivotable beam is in the upper position at a distance of the associated outer support and has a freedom of movement up and down relative to the outer support, wherein the at least one pendulum arm has a freedom of movement in at least two, in particular three degrees of freedom relative to the associated pivotable beam and wherein the leg connector has a freedom of movement in at least two, in particular three degrees of freedom relative to the at least one pendulum arm to which it is connected, and wherein the horizontal restrainers are freely movable,
- a supporting mode, in which the pivotable beams are in the lower position and rest on the outer supports, wherein the at least one pendulum arm has a freedom of movement in at least two, in particular three degrees of freedom relative to the associated pivotable beam and wherein the leg connector has a freedom of movement in at least two, in particular three degrees of freedom relative to the at least one pendulum arm to which it is connected, and wherein the horizontal restrainers substantially fixate a higher position of the leg in an X-direction and Y-direction relative to the base frame.

The lifting device may be operated passively, i.e. without applying substantial energy, in both the free moving mode and the supporting mode.

In an embodiment, the lifting device comprises a positioning system for positioning the leg connectors relative to the legs in at least two, and in particular three dimensions. This allows a fast and reliable positioning relative to the legs.

In an embodiment, the leg connector comprises:

- a leg contact member constructed to extend substantially around a leg of the sea platform, the leg contact member defining a upper abutment surface configured to abut a lower abutment surface of a collar,
- a vertical post extending upwardly from the leg contact member and comprising mounting positions for the at least two horizontal restrainers, the mounting positions being provided at a vertical distance above the lower abutment surface of the collar.

The vertical post allows the horizontal restrainers to be directed at a higher position than the position of the leg connectors. In an embodiment, the vertical post is telescoping in order to adjust a height thereof.

In a modified version, the invention provides a lifting device for lifting a sea platform, in particular an upper part of the sea platform, the sea platform comprising a support structure and a top side, the lifting device being constructed to be positioned on a lifting vessel, the lifting device comprising:

a base frame constructed to rest on the lifting vessel, at least one console mechanism comprising a flexible connection system, wherein the console mechanism extends outwardly away from the base frame over a horizontal distance, a suspension system connected to the console mechanism or to the base frame and comprising a leg connector which is constructed to be connected to a leg of the sea platform, wherein the suspension system is constructed to allow freedom of movement of the leg connector relative to the console mechanism, wherein the suspension system comprises at least one pivotable beam which extends outwardly away from the base frame over a horizontal distance and is pivotable about a horizontal pivot axis relative to the base frame, and wherein the lifting device comprises a pivotable beam actuator for pivoting the pivotable beam between an upper position and a lower position, wherein the lifting device is constructed to be switched from a:

free-moving mode in which the lifting device provides a low stiffness and a low counterforce against a downward pivotal movement of the suspension system, wherein in the free-moving mode the pivotable beam actuator holds the pivotable beam in the upper position and provides a low stiffness and a low counterforce against a downward pivotal movement of the pivotable beam to a supporting mode, in which the pivotable beam is in the lower position, wherein the lifting device provide a high stiffness and a high counterforce against said downward pivotal movement of the suspension system, wherein in the supporting mode the flexible connection system forms a flexible connection between the base frame and the suspension system and the console mechanism supports the pivotable beam at an outer support point at a horizontal distance from the base frame against a downward pivotal movement and provides a high stiffness and a high counterforce against said downward pivotal movement of the pivotable beam in comparison with the relatively low stiffness of the pivotable beam actuator and allows a limited movement of the pivotable beam together with the console mechanism relative to the base frame.

Although this is a modification, this embodiment relates to the same invention as the first mentioned embodiment. It has a console mechanism rather than a console frame, but it has substantially the same advantages as the first mentioned embodiment. The different stiffness to the pivotal movement of the pivotable beam in the free moving mode and the supporting mode creates a vertical freedom of movement of the lifting vessel relative to the sea platform during a lifting operation and a relatively rigid (but not completely rigid) connection between the lifting vessel and the sea platform during a transport operation.

It was found that this embodiment is relatively simple and reliable in operation.

In an embodiment, the suspension system comprises at least one pendulum arm being connected at an upper end thereof to a protruding end of the pivotable beam via a pendulum hinge, wherein the leg connector is attached to a lower end of the at least one pendulum arm via a leg connector hinge, wherein the suspension system is constructed to allow freedom of movement of the leg connector relative to the pivotable beam. The pendulum arm and the hinges provide a horizontal freedom of movement of the lifting vessel relative to the sea platform.

In an embodiment, the at least one pivotable beam is connected to the console mechanism or to the base frame, wherein the console mechanism is connected to the pivotable beam at the support point and pivots with the pivoting movement of the pivotable beam, and wherein the base frame comprises a support base having an abutment surface, wherein the console mechanism comprises a foot having a mating support surface, wherein in the upper position of the pivotable beam the foot is positioned at a distance above the support base and the pivotable beam is allowed to pivot over an angle R, wherein in the upper position of the pivotable beam the lifting device is in the free-moving mode, and wherein the foot engages the support base when the pivotable beam pivots to a lower position, wherein the flexible connection system is activated by the engagement and the lifting device is switched to the supporting mode. The foot and the support base create a simple and reliable way of activating the flexible connection system.

The console mechanism may pivot about a pivot axis which lies close to or is in the same position as the pivot axis of the pivotable beam.

In an embodiment, the console mechanism extends outwardly away from the base frame and is pivotable about a horizontal pivot axis relative to the base frame, wherein in the supporting mode the console mechanism supports the pivotable beam at an outer support point at a horizontal distance from the base frame. The console mechanism is connected to the pivotable beam at the outer support point.

The present invention further relates to a lifting vessel comprising a hull and two arms which define a docking bay between them, wherein on each arm a plurality of lifting devices according to the invention are positioned, wherein the suspension systems extend into the docking bay.

In an embodiment of the lifting vessel, the lifting arms are movable relative to the hull and wherein an angle $\gamma$ between the lifting arms can be varied, and wherein in particular two parallel tracks are provided on the deck of the hull, wherein each lifting arms rest on said tracks via at least two movable carriages, one carriage for each track, and wherein both the distance and the angle between the arms can be varied by moving said carriages.

In an embodiment of the lifting vessel, each lifting arm comprises a skidding system extending along a longitudinal direction of the lifting arm, the skidding system being constructed for skidding the lifting devices relative to the lifting arms.

The present invention further relates to a method for lifting a sea platform, in particular an upper part of the sea platform, which sea platform comprises a support structure and a top side, the method comprising:

providing the lifting vessel according to the invention, and positioning the lifting devices on the lifting arms in a required position to engage the legs of the sea platform, and pivoting the pivotable beams of the lifting devices to the upper position, positioning the lifting vessel near the sea platform, wherein the sea platform is positioned in the docking bay between the lifting arms, engaging the leg connectors of the lifting devices with the legs of the sea platform, deballasting the lifting vessel, wherein the pivotable beams pivot from the upper position to the lower position and engage the outer supports of the console frames, lifting the upper part of the sea platform from the lower part, and moving the combination of the lifting vessel and the upper part of the sea platform away from the substructure.

The method has the same advantages as the lifting device according to the invention. The sea platform may have a row of legs on each side and the lifting arms may be positioned parallel to the rows of the legs on both sides of the sea platform.

The method may include repositioning the lifting arms of the vessel in order to extend parallel to one side of the sea platform and parallel to an opposite side of the sea platform.

The method will generally include cutting the legs of the support structure under the leg connectors, thereby dividing the sea platform in an upper part and a lower part. This can generally be done in non-critical time.

The method may include connecting the horizontal restrainers to the legs of the sea platform. Preferably this is done on one side of the sea platform only.

In an embodiment of method, the flexible connection systems of the lifting device are tuned during the lift. This is advantageous in keeping the upper part of the lifted sea platform horizontal.

In an embodiment of method, prior to making contact between the lifting vessel and the sea platform, the flexible connection systems are tuned to achieve a specific stiffness range according to the specific expected loads by removing or adding or replacing resilient blocks and/or pre-tensioning the actuation system at a predetermined level.

In an embodiment of method, the stiffness range of the individual flexible connection systems of the lifting devices are individually tuned and differ from one another in order to allow the flexible connection systems to accommodate to differing forces experienced by each connection point during lifting operation.

One of the main benefits of this embodiment is that it accommodates for incorrect calculations in the centre of gravity of the sea platform. This may lead to an uneven distribution of the forces on the different lifting devices, and to a non-vertical orientation of the lifted sea platform. By tuning the different flexible connection systems individually, the forces may be redistributed and/or the lifting vessel may be turned upright. This advantage may be combined with the passive character of the lifting device, i.e. once tuned, no more energy may be required for the lifting devices to continue the lifting operation.

In an embodiment of method, the upper part of the sea platform is lifted from the lower part of the sea platform in a single lift.

In an embodiment, the method comprises a step of connecting collars to the legs of the sea platform, wherein the leg connectors engage the collars during the lifting step and exert the lift force on the sea platform via the collars.

In an embodiment of method, the collars are attached to the legs above the position where the leg connectors engage the legs.

In an embodiment, the method comprises:

engaging the legs with the leg connectors, moving the leg connectors upwardly against collars on the legs, by pivoting the pivotable beams upwards, wherein the lifting devices of the lifting vessel are in a free-moving mode, in which the leg connectors are relatively free to move relative to the base frame, and in which the horizontal restrainers are free to moving and do not support the legs, after engaging with the legs, switching to a supporting mode by de-ballasting the lifting vessel, wherein the pivotable beams are moved to the lower position and engage the outer supports, wherein the at least one pendulum arm has a freedom of movement in at least two, and wherein the horizontal restrainers support the legs in the horizontal X-direction and Y-direction, and in particular act as a spring.

In an embodiment, initially the lifting arms are oriented in a diverging arrangement, and wherein after engagement of the lifting devices with the legs which are closest to a blind end of the docking bay the lifting arms are pivoted to a parallel orientation about said legs, wherein subsequently the lifting devices engage one by one with the legs starting from said first leg and going in the direction of free ends of the lifting arms by rotating the arms in a more parallel orientation about the first leg.

In an embodiment of method, an operator who controls the lifting arms controls the subsequent contacting of the leg connectors by only moving one point of each lifting arm, in particular by moving a single carriage.

In an embodiment of method, a blind end of the docking bay is engaged with the platform, in particular via fenders.

These and other aspects of the invention will be more readily appreciated as the same becomes better understood by reference to the following detailed description and considered in connection with the accompanying drawings in which like reference symbols designate like parts.

DETAILED DESCRIPTION OF THE FIGURES

The Lifting Vessel and Sea Platform

Figure 4:
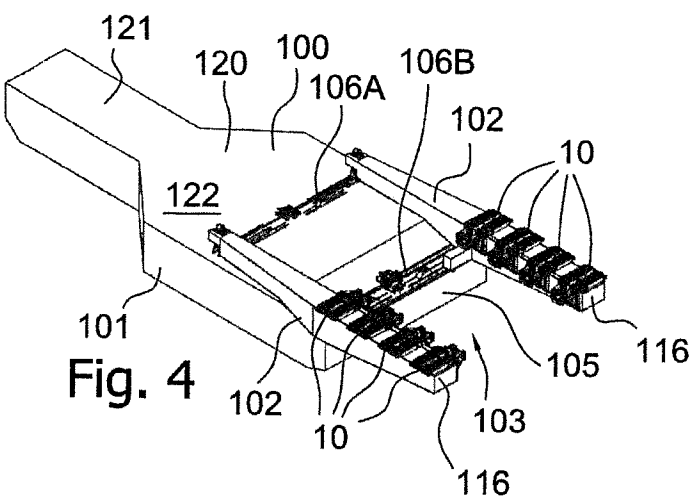
FIG. 4 shows an isometric view of a lifting vessel according to the invention.
Figure 3:
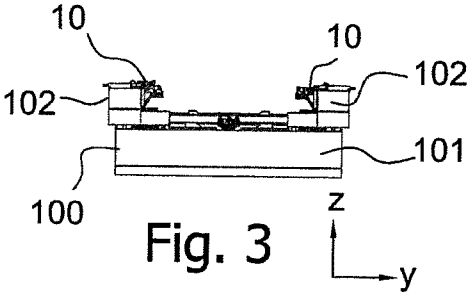
FIG. 3 shows a front view of a lifting vessel according to the invention.
Figure 2:
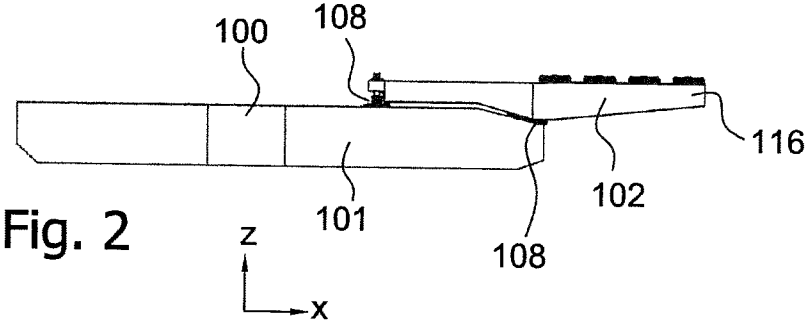
FIG. 2 shows a side view of a lifting vessel according to the invention.

With reference to FIGS. 1A, 1B, 2, 3 and 4 a lifting vessel 100 comprises a hull 101 and two arms 102 which define a docking bay 103 between them. The arms protrude to the rear or to the front of the hull. The vessel may comprise a ballasting system 107 with which the draft of the vessel can be varied. The hull may comprise a wide section 120 which supports the arms and a narrow section 121 which protrudes away from the docking bay.

The arms rest on the deck 122 of the vessel. The arms 102 may protrude over distance of between 10 and 40 meter.

On each arm 102 a plurality of lifting devices 10 according to the invention are positioned. The lifting devices are secured to the arms. The suspension systems 18 (further discussed below) extend into the docking bay. The vessel may comprise propulsion system but may also be a towed barge.

The lifting arms 102 are movable relative to the hull 101. An angle γ between the lifting arms can be varied, see in particular FIG. 1B. Two parallel tracks 106A, 106B are provided on the deck 122 of the hull. Each lifting arms 102 rest on said tracks via at least two movable carriages 108, wherein one carriage per lifting arm is provided for each track. Both the distance 124 and the angle γ between the lifting arms can be varied by moving said carriages 108 over the tracks.

Each lifting arm comprises a skidding system 110 which extends along a longitudinal direction of the lifting arm. The skidding system is constructed in order to move the lifting devices 10 relative to the lifting arms. Each arm may 102 comprise four lifting devices 10, but a different number is also possible.

Figure 15:
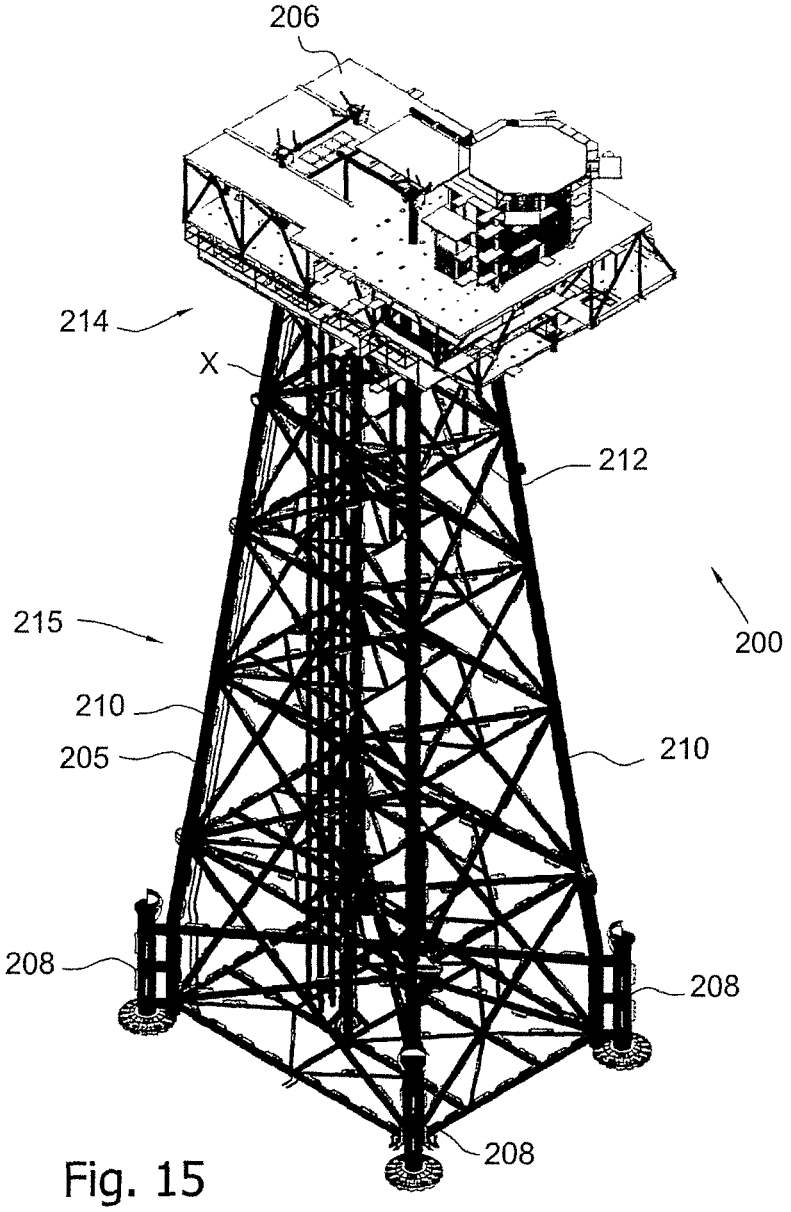
FIG. 15 shows a isometric view of a sea platform.

With reference to FIG. 15, the sea platform 200 is shown. The sea platform comprises a support structure 205 and a top side 206. The support structure is often referred to as a jacket and comprises legs 210. The support structure is generally positioned on the seabed via pods 208 and comprises many beams 212, generally made of steel. The beams generally extend horizontally and diagonally and interconnect the legs 210.

With "X" the position in which the sea platform is divided in an upper part 214 and a lower part 215 is indicated. The upper part 214 is the part which is lifted with the present invention. The upper part 214 comprises the top side and a portion of the jacket. Such sea platforms have a life span of 20-50 years after which they generally need to be dismantled.

The Lifting Device

With reference to FIGS. 5, 6, 7, 8 and 9, a lifting device 10 is shown for lifting an upper part 214 of a sea platform.

The lifting device is constructed to be positioned on the lifting vessel 100 more in particular on the legs 102 of the lifting vessel. The lifting device comprises a base frame 12 which is constructed to rest on the lifting vessel.

The base frame 12 is configured to be positioned on a lifting arm 102 of a lifting vessel. The base frame 12 comprises a deck part 32 and a side part 33. The deck part and the side part may be connected to one another via a hinge 41. A relatively small section 37 of the side part 33 may rest on the deck as well.

The base frame 12 defines a number of pivot points 70. The pivot points define a pivot axis 71 of the console frame relative to the base frame.

The side part 33 which extends downwards from the deck part, wherein the pivot points 70 are provided on the side part. The pivot points 70 are positioned at a distance 49 below the deck part 32. The deck part and the side part (apart from the deck section 37 thereof) typically extend at an angle of 90 degrees relative to one another.

The deck part 32 comprises deck beams 30 which are interconnected via transverse beams 36.

The lifting device further comprises at least one console frame 14 and a flexible connection system 16, further elucidated below. The console frame 14 defines a console which extends outwardly from the base frame over a horizontal distance 47. The console frame 14 is connected to the base frame via the pivot points in order to make a pivoting movement about a pivot axis 71 relative to the base frame. In side view (see FIG. 9), the console frame 14 comprises a vertical beam 140, a horizontal beam 141 projecting outwardly and a diagonal beam 142 extending from a lower end 143 of the vertical beam to the outer end of the horizontal beam. Other shapes are possible.

The lifting device further comprise a suspension system 18 which is connected to the console frame 14 and comprises a leg connector 20 which is constructed to be connected to a leg 210 of the sea platform. The suspension system is constructed to allow freedom of movement of the leg connector 20 relative to the console frame 14.

The flexible connection system 16 forms a flexible connection between the console frame 14 and the base frame 12 and allows a limited movement of the console frame relative to the base frame. As will be discussed further below, this is necessary to prevent excessive forces on the sea platform during transport.

The console frame 14 comprises an outer support 73. The outer support 73 forms a support on which the pivotable beam may rest. The console frame 14 further comprises at least one upper connection point 74 on which the flexible connection system 16 acts.

The suspension system 18 comprises at least one pivotable beam 75 which is connected to the console frame or the base frame via a hinging connection 76 which allows the pivotable beam 75 to pivot relative to the base frame between a lower position and an upper position. The hinging connection 76 defines a pivot axis 176 (see FIG. 13A). The pivotable beam 75 extends outwardly away from the base frame over a distance 48. The horizontal distance 47 over which the console frame projects from the base frame may be 40-100 percent, in particular 40-80 percent of the distance 48 over which the pivotable beam projects from the base frame.

In the lower position the pivotable beam engages the outer support 73 and is supported by the console frame 14. In the upper position the pivotable beam is positioned at a distance above the outer support and is allowed to pivot over an angle β (see FIG. 9), in order to allow the upper part of the sea platform to move in a vertical direction relative to the lifting vessel.

In the lower position, any further downward movement of the pivotable beam relative to the base frame is determined by the stiffness of the flexible connection system between the console and the base frame.

The suspension system 18 further comprises a pivotable beam actuator 83 (see FIG. 8) for pivoting the pivotable beam between the upper position and the lower position. This pivotable beam actuator 83 is a hydraulic cylinder and extends between a point 301 on the console and a point 300 on the pivotable beam.

The pivotable beam actuator 83 may be used to pretension the leg connector 20 against the collar 60 on the leg 210 in a pretention stage. In this way, vertical displacements of the arms 102 relative to the jacket which are caused by the barge motions and which occur prior to the load transfer stage can be compensated. In the pretension stage, the pivotable beam actuator 83 determines a vertical stiffness of the outer end of the pivotable beam and therefore a vertical stiffness of the connector relative to the base frame.

As an alternative the pivotable beam actuator 83 may be connected directly to the side part 33 of the base frame, i.e. the point 301 may be located on the side part 33 of the base frame.

The suspension system 18 further comprises at least one pendulum arm 77 connected at an upper end 78 thereof to a protruding end 79 of the pivotable beam via a pendulum hinge 80. The suspension system 18 further comprises the at least one leg connector 20 constructed to be connected to the leg, wherein the at least one leg connector is attached to a lower end 81 of the at least one pendulum arm via a leg connector hinge 82.

The lifting device is capable of switching between a supporting mode and a free-moving mode as will be discussed below.

The lifting device may comprise two console frames 14 and two pivotable beams 75, wherein each console frame is configured to support an associated pivotable beam via its outer support, and wherein each pivotable beam supports a pendulum arm 18, wherein the leg connector 20 is supported on two opposite sides by the lower end of each pendulum arm.

The at least one pendulum hinge 80 between the pendulum arms and the pivotable beams and the at least one leg connector hinge 82 between the at least one pendulum arm and the at least one leg connector can be gimbal hinges which allow rotation about three independent axis of the pendulum arms 77 relative to the pivotable beams 75 and of the leg connectors 20 relative to the pendulum arms 77.

The pivotable beams 75 pivot about a horizontal pivot axis 176, and the console frame also pivots about a horizontal pivot axis.

The Flexible Connection System

The flexible connection system 16 acts on the deck part 32 of the base frame and on an upper part 34 of the console frame 14.

The flexible connection system 16 comprises an actuation system 22 which extends between the base frame 12 and the console frame 14. The flexible connection system 16 comprises connection beams 26 which extend horizontally from an upper part of the console frame 14. The connection beams 26 may be connected to the console frame 14 via hinges 39. The hinges 39 have a horizontal hinge axis and allow the console frame 14 to pivot while the connection beams 26 stay substantially horizontal.

The connection beams 26 extend parallel to the deck beams 30 of a deck part 32 of the base frame.

The flexible connection system 16 comprises resilient members 28 which allow the console frame 14 to be displaced relative to the base frame 12 over a limited angle by deformation of the resilient members. The displacement may be a pivotal movement about the pivot axis 71 defined by the pivot points 70. The resilient members are configured to deform under shear stress, and may be rubber blocks. The rubber blocks are placed between the connection beams 26 and the deck beams 30 and deform when the connection beam displace relative to the deck beams. The resilient members interconnect the connection beams and the deck beams The flexible connection system 16 is configured to exert a force on the console frame 14. The force depends on the displacement of the console frame relative to the base frame. A load-displacement relationship of the flexible connection system is variable.

The resilient members 28 and the actuation system 22 act in parallel on the console frame, i.e. their forces are added to form a combined (horizontal) force on the console frame via the connection beams.

The load—displacement relationship, or 'stiffness' between the base frame 12 and the console frame 14 as defined by the flexible connection system 16 is adjustable in two ways:

1) by varying the number and/or position of the resilient members 28, and 2) by adjusting the actuation system 22.

These options provide better fine tuning capabilities. The stiffness of the connection between the lifting vessel and the leg 210 can be adjusted to a predetermined value, can be controlled more accurately, is more robust, and is able to compensate for varying load distributions. More-over the stiffness can be modified after the lifting operation has begun and the lifting devices are under a load.

If the hydraulics fail, the resilient members still are able to hold the load.

The hydraulic system can be smaller in comparison with a system without the resilient members. The hydraulic system can be also be simpler in comparison with a system without the resilient members.

The actuation system 22 may be adjusted to apply an adjustable force on the console frame when the console frame is in a neutral position 29 in which the resilient members are not under tension. Therefore, when the resilient member do not exert any force on the console frame the actuation system may exert a force on the console frame (via the connection beams)

Typically the actuation system 22 comprises at least one cylinder 24, in particular a hydraulic cylinder, and a pump to control a pressure in the cylinder. The pressure may be adjustable according to the requirements. This provides a wide range of available load-displacement relationships.

The actuation system 22 may comprise at least one accumulator which is configured to let the cylinder act as a spring, having a spring constant. The force exerted by the actuation system on the console frame via the connection beams is dependent on the displacement of the console frame relative to the base frame.

The actuation system 22 is configured to operate in a passive mode, without applying external energy. This provides a benefit over known systems that much less energy is required during transport of the sea platform.

The Horizontal Restrainers

Figure 12:
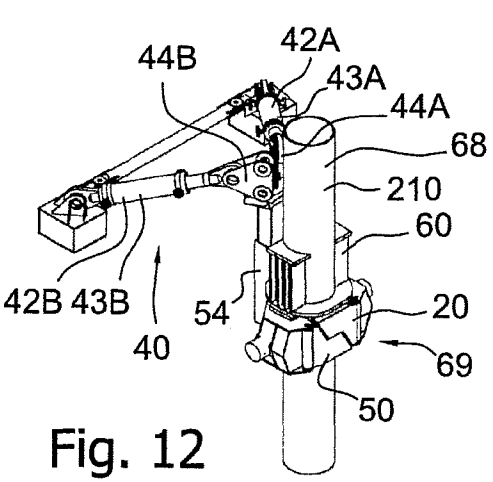
FIG. 12 shows an isometric view of a horizontal restraining system according to the invention.
Figure 10:
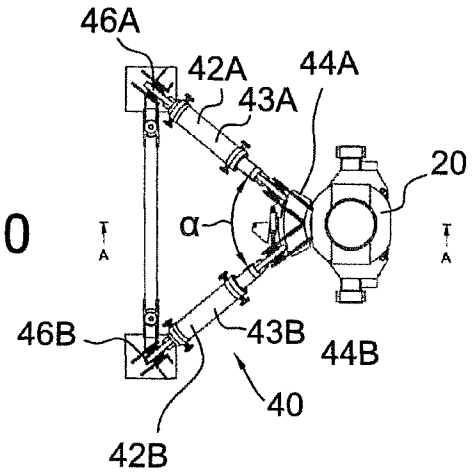
FIG. 10 shows a top view of a horizontal restraining system according to the invention.
Figure 11:
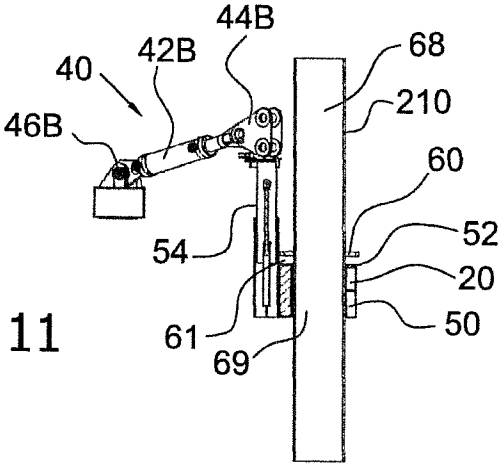
FIG. 11 shows a side view of a horizontal restraining system according to the invention.

With reference to FIGS. 10, 11, and 12, if too large bending moments occur in the legs 210, the legs 210 may deform or even break. In the lifting device 10, large bending moments in the legs 210 are therefore to be avoided. To this end, the lifting device 10 comprises a horizontal restraining system 40 for limiting a horizontal movement of the legs 210. The suspension system 18 is configured to exert a vertical force on the legs 210 via the leg connector 20, and the horizontal restraining system 40 is configured to exert a horizontal force on the leg 210.

The horizontal restraining system 40 comprises at least two horizontal restrainers 42A, 42B (also generally indicated with 42). These are constructed to limit the horizontal movement of the leg 210 in an X-direction and an Y-direction. The X-direction is a longitudinal direction of a lifting vessel and the Y-direction is the transverse direction of the lifting vessel.

The at least two horizontal restrainers 42A, 42B are connected at one end to respective restraining support positions 46A, 46B on the base frame and are configured to be connected at an opposite end to the leg 210, directly or indirectly via a collar 60 which is attached to the leg. The horizontal restrainers 42 are positioned at a vertical distance 130 above the leg connector 20, and in particular above a deck part 32 of the base frame. The horizontal restrainers are directed at a part 68 of the leg which is substantially closer to the top side of the sea platform than a part 69 of the leg on which the leg connector acts. Said vertical distance 130 may in particular be greater than 2 meter, but may be larger for instance 5 meter. Each horizontal restrainer 42A, 42B may comprise hydraulic cylinders 43A, 43B. The hydraulic cylinders extend substantially horizontally, i.e. over an angle of less than 15 degrees to the horizontal.

The distal ends 44A, 44B of the horizontal restrainers are positioned higher than a deck part 32 of the base frame and wherein the leg connector 20 is positioned lower than the deck part.

In top view the horizontal restrainers extend at an angle $\alpha$ of between 70 and 110 degrees relative to one another, see FIG. 10.

Each horizontal restrainer may be configured to act as a spring, in particular with an adjustable spring constant which is set prior to the operation. The horizontal restrainers may be inactive during the lifting operation, i.e. they may be set in a free-moving mode during the lifting operation. Typically the horizontal restrainers are activated for the transport operation and may be configured to operate in a passive mode for the transport operation. In other words, the horizontal restrainers operate without applying external energy during the transport operation. This may be performed by applying a predetermined pressure on the horizontal restrainers.

However, it is also possible to actively monitor the pressure in the cylinder during the transport operation and to continuously adjust the pressure in the cylinder.

A load-displacement relationship of the horizontal restrainers is adjustable by changing the pressure in the cylinder, in particular independently for each of the two horizontal restrainers.

The lifting device 10 is configured to exert vertical forces on the legs via the suspension system 18 and the leg connectors 20. The lifting device is configured to exert horizontal forces on the legs 210 via the horizontal restraining system 40 and the leg connectors. The suspension system 18 and the horizontal restraining system 40 are constructed to substantially prevent horizontal forces to be exerted onto the legs via the suspension system. This advantageously prevents large moments from occurring in the legs 210. The horizontal restraining system and the pivotable beam are separate. The horizontal forces are not transferred via the pivotable beam, or only for a small part.

The leg connectors 20 have an abutment surface 52 at an upper side thereof and are constructed to slide relative to the legs in order to exert a vertical force onto the legs via the abutment surface and via a collar 60 which is attached to the leg above a position where the leg connectors are engaged with the leg. The leg connectors therefore are not gripping devices.

The lifting device can be switched between a:

1) a free-moving mode, in which the at least one pivotable beam 75 is in the upper position at a distance of the associated outer support and has a freedom of movement up and down relative to the outer support. The at least one pendulum arm has a freedom of movement in at least two, in particular three degrees of freedom relative to the associated pivotable beam 75 and the leg connector 20 has a freedom of movement in at least two, in particular three degrees of freedom relative to the at least one pendulum arm to which it is connected. The horizontal restrainers are freely movable. The vertical stiffness of the pivotable beam 75 and consequently the vertical stiffness of the leg connector relative to the base frame is determined by the pivotable beam actuator 83 and the flexible connection system 16 in case the pivotable beam actuator 83 is connected to the console frame or by the pivotable beam actuator 83 by itself in case the pivotable beam actuator 83 is connected directly to the base frame.

2) a supporting mode, in which the pivotable beams are in the lower position and rest on the outer supports, wherein the at least one pendulum arm has a freedom of movement in at least two, in particular three degrees of freedom relative to the associated pivotable beam and wherein the leg connector has a freedom of movement in at least two, in particular three degrees of freedom relative to the at least one pendulum arm to which it is connected, and wherein the horizontal restrainers substantially fixate a higher position of the leg in an X-direction and Y-direction relative to the base frame. In the supporting mode, the vertical stiffness of the pivotable beam relative to the base frame and consequently the vertical stiffness of the leg connector relative to the base frame is determined by the flexible connection system.

The free moving mode is used during the lifting operation, wherein the lifting vessel is allowed to move relative to the sea platform. The supporting mode is used during the transport operation, after lift off and during the subsequent transport to shore.

The lifting device may comprise a positioning system for positioning the leg connectors relative to the legs in at least two, and in particular three dimensions. The leg connector 20 comprises a leg contact member 50 constructed to extend substantially around a leg of the sea platform. The leg contact member 50 has doors 135 which open up to allow the leg 210 to move within the leg contact member. When the doors 135 close again, the leg contact member forms an annular shape around the leg. The leg contact member defines an upper abutment surface 52 configured to abut a lower abutment surface 62 of a collar 60.

The leg connector 20 may further comprise a vertical post 54 extending upwardly from the leg contact member 50 and comprising mounting positions 56 for the at least two horizontal restrainers, the mounting positions being provided at a vertical distance above the lower abutment surface 61 of the collar.

As is shown in FIGS. 11 and 12, the vertical post 54 comprises telescoping parts in order to adjust a height thereof.

Figure 16A:
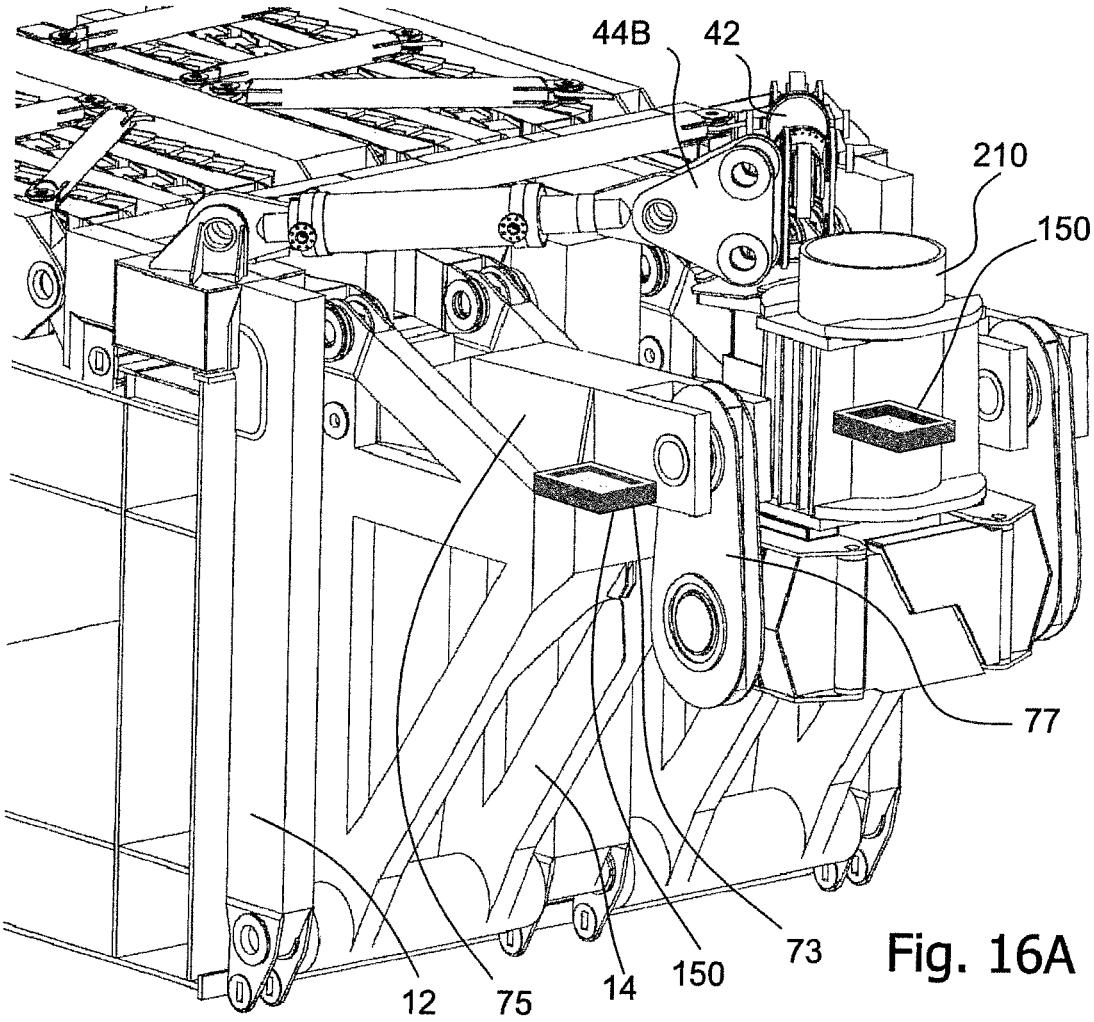
FIGS. 16A and 16B show further options for tuning the lifting devices.

Turning to FIG. 16, it may be required to provide further tuning of the lifting device, in particular to a collar position on the legs which is deviant from a target position thereof. To this end, shim plates (or resilient elements) 150 may be provided on the outer support in order to raise the position of the outer support 73, thereby raising the lower position of the pivotable beams 75 and consequently the lifting position of the leg connectors. The elements 150 are shown in foreground mode, because otherwise they would be concealed.

Figure 16B:
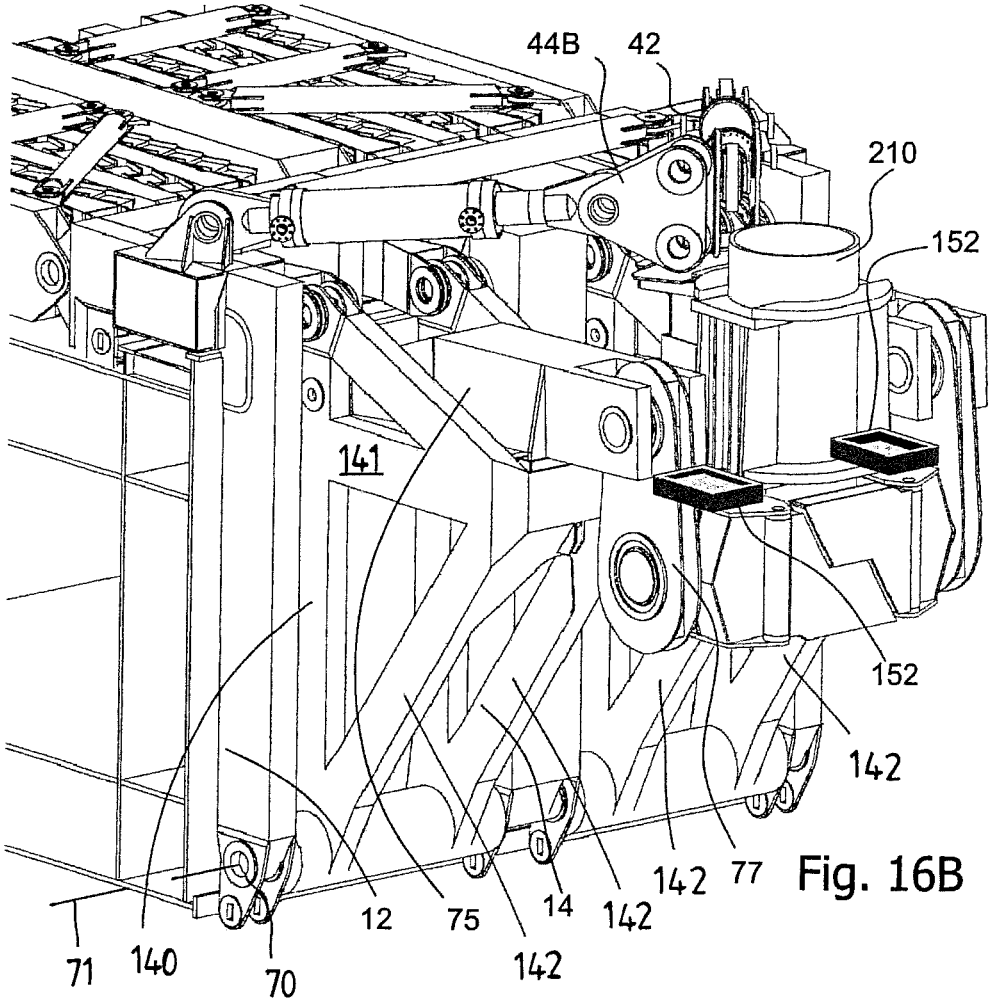
Figure 17:
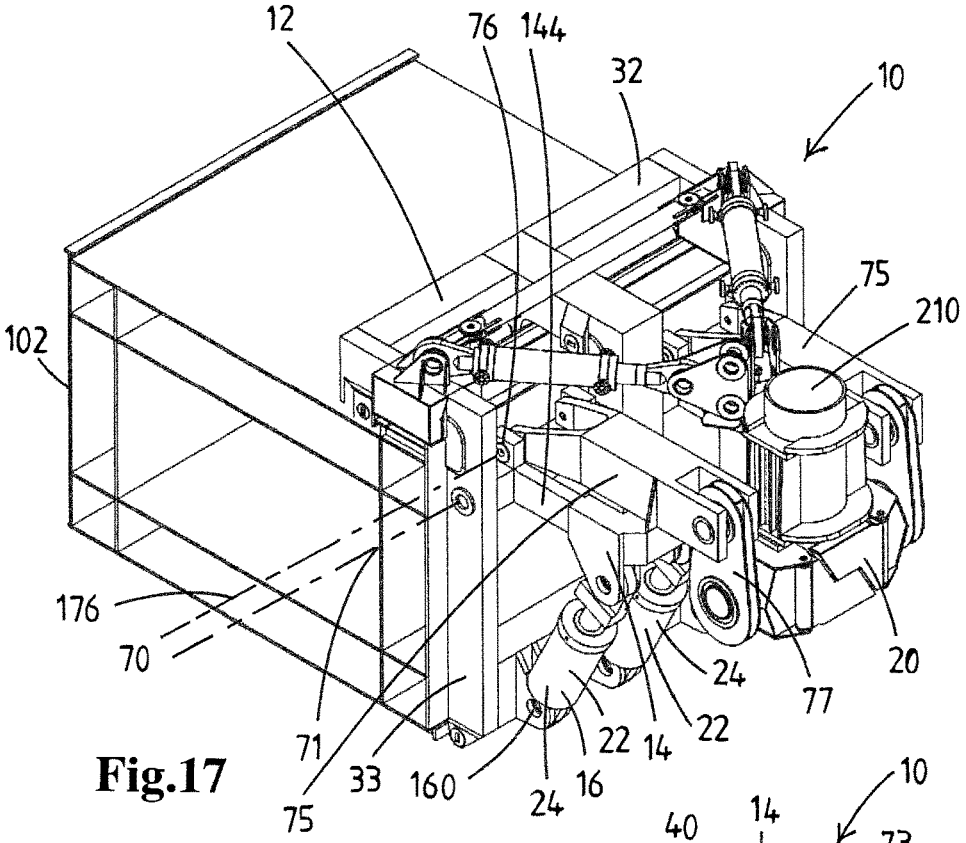
FIG. 17 shows an isometric view of another embodiment of the invention.
Figure 18:
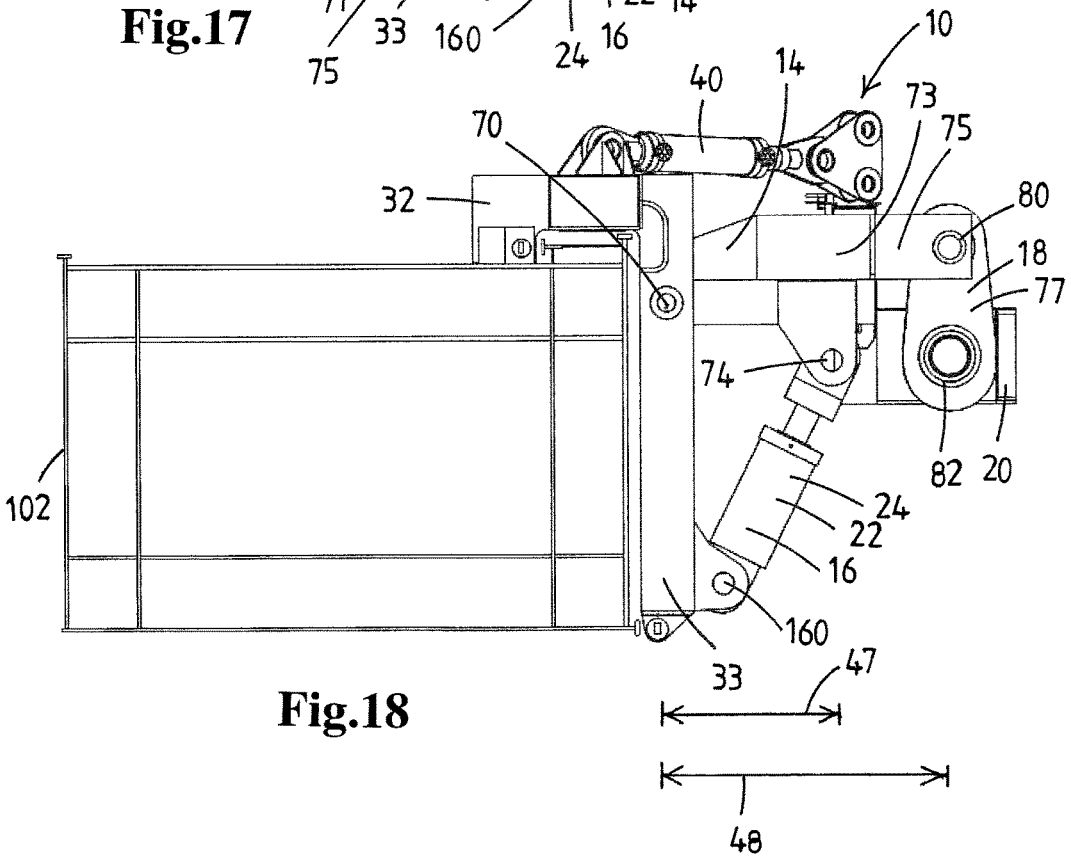
FIG. 18 shows a side view of the embodiment of FIG. 17.
Figure 19:
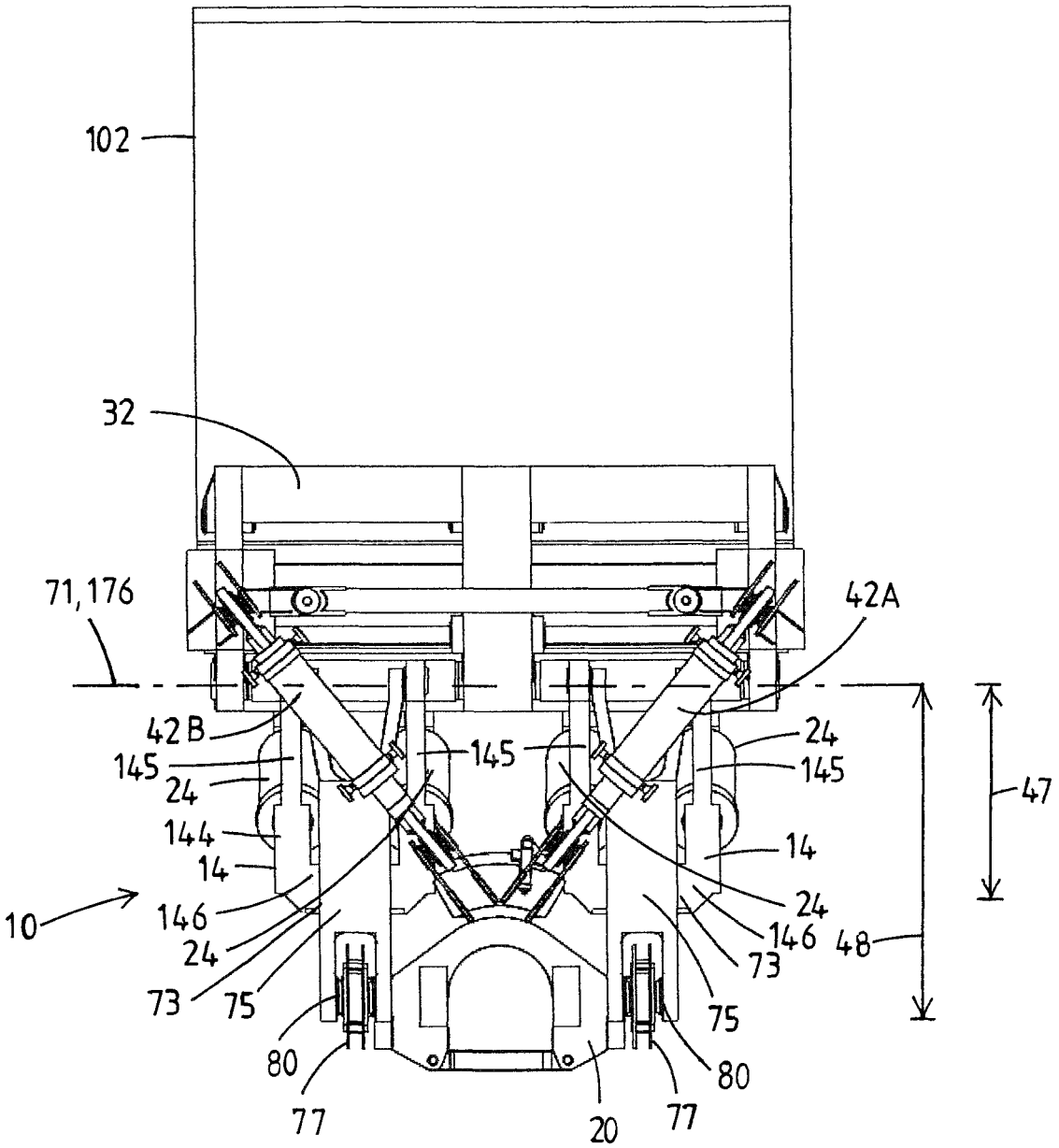
FIG. 19 shows a top view of the embodiment of FIG. 17.
Figure 20:
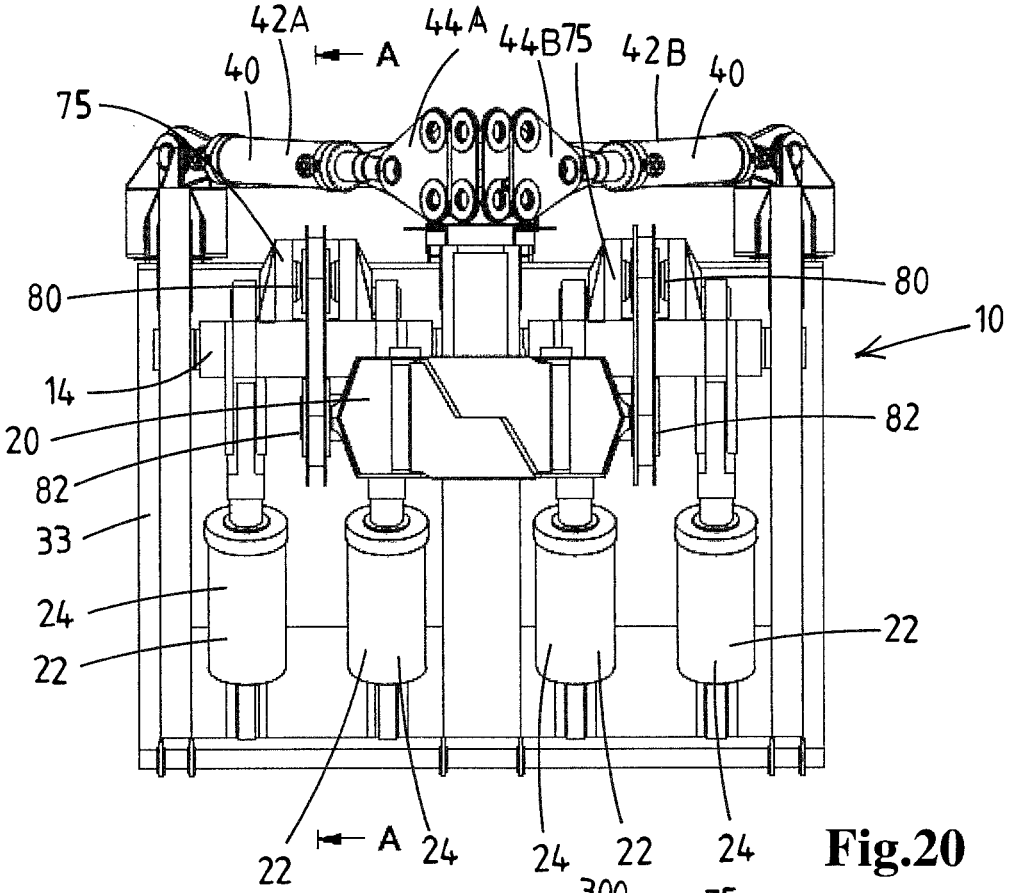
FIG. 20 shows a front view of the embodiment of FIG. 17.
Figure 21:
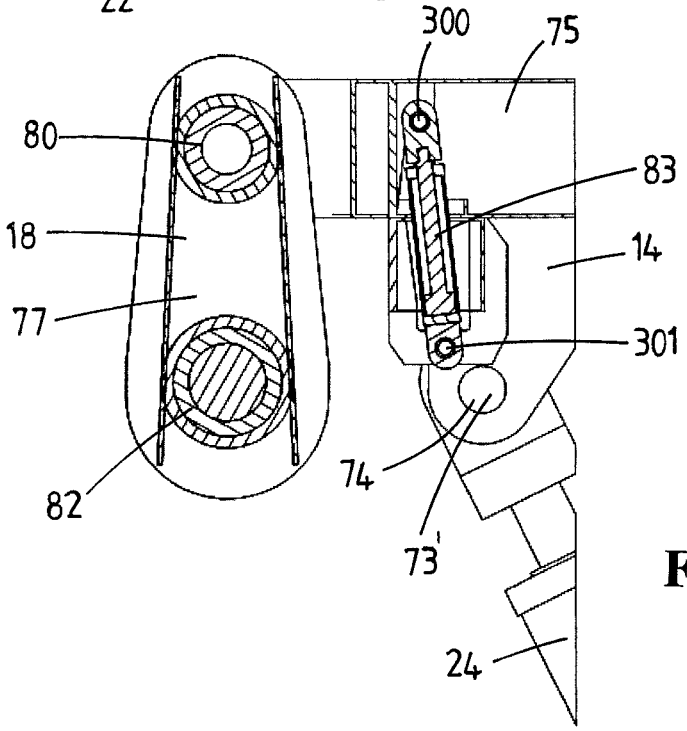
FIG. 21 shows a detailed sectional side view according the lines A-A in FIG. 20.
Figure 22:
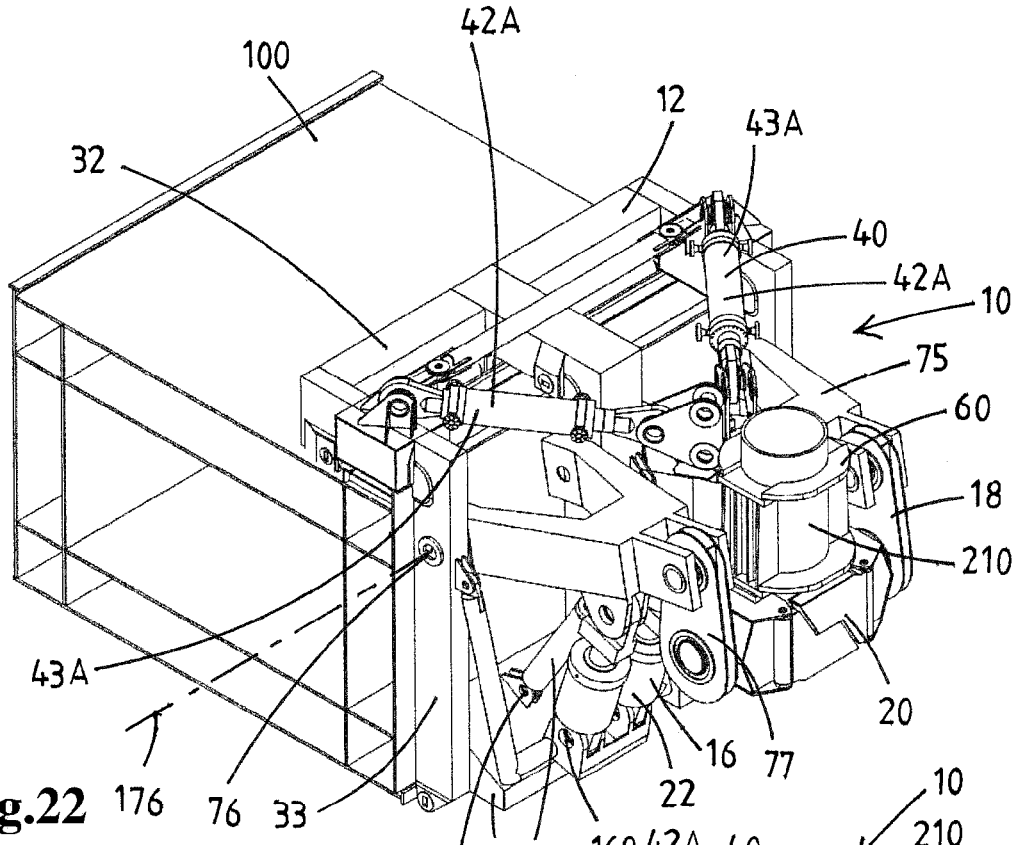
FIG. 22 shows an isometric view of yet another embodiment of the invention.
Figure 23:
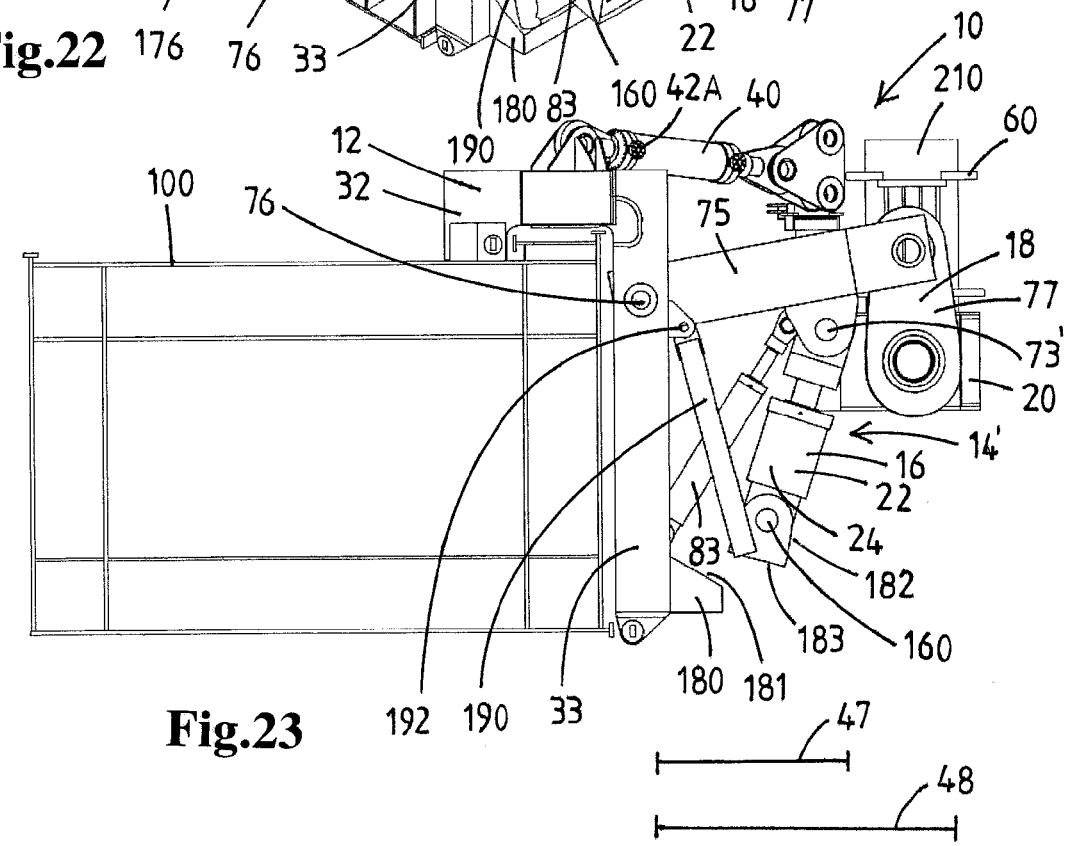
FIG. 23 shows a side view of the embodiment of FIG. 22.
Figure 24:
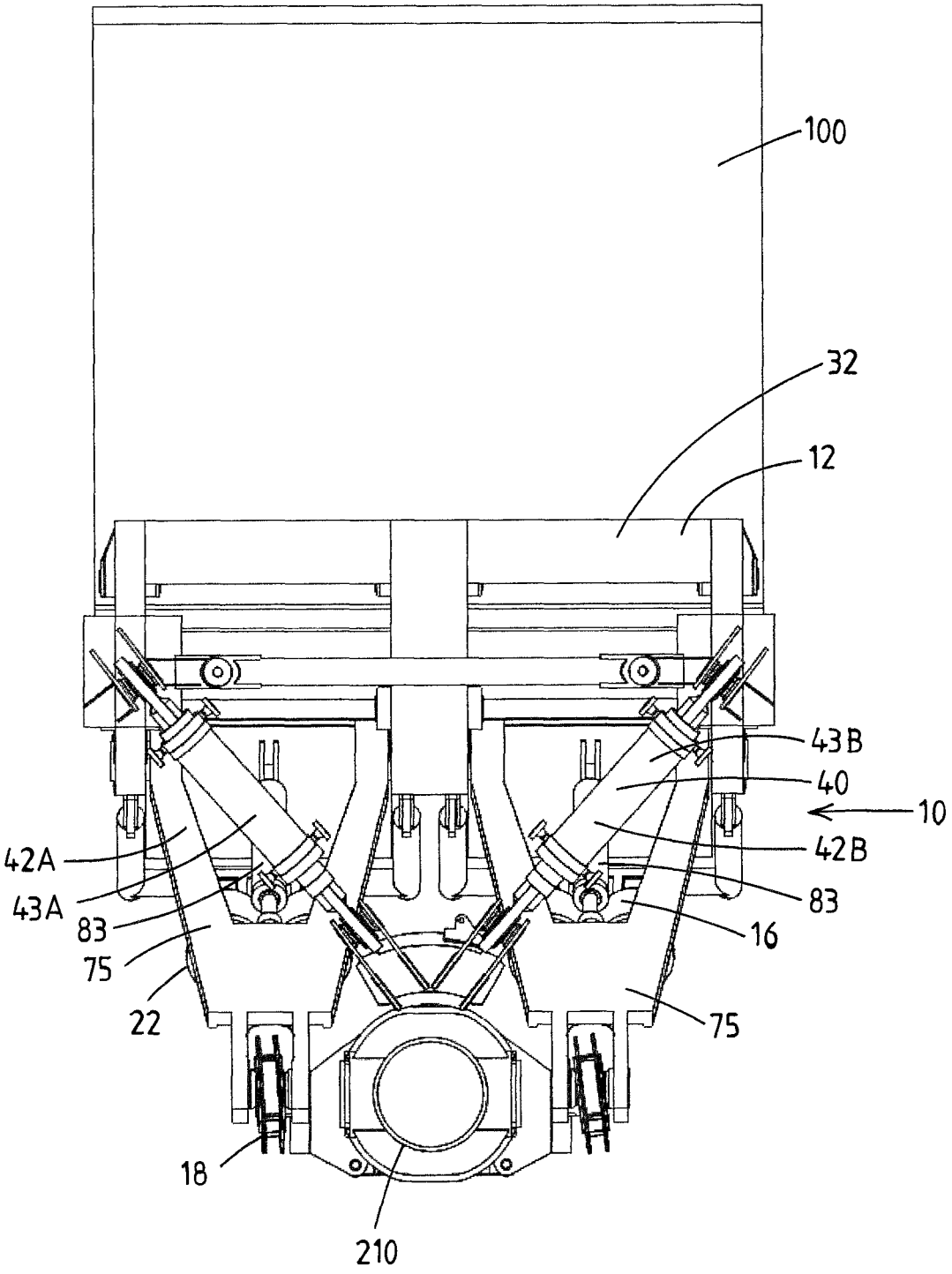
FIG. 24 shows a top view of the embodiment of FIG. 22.
Figure 25:
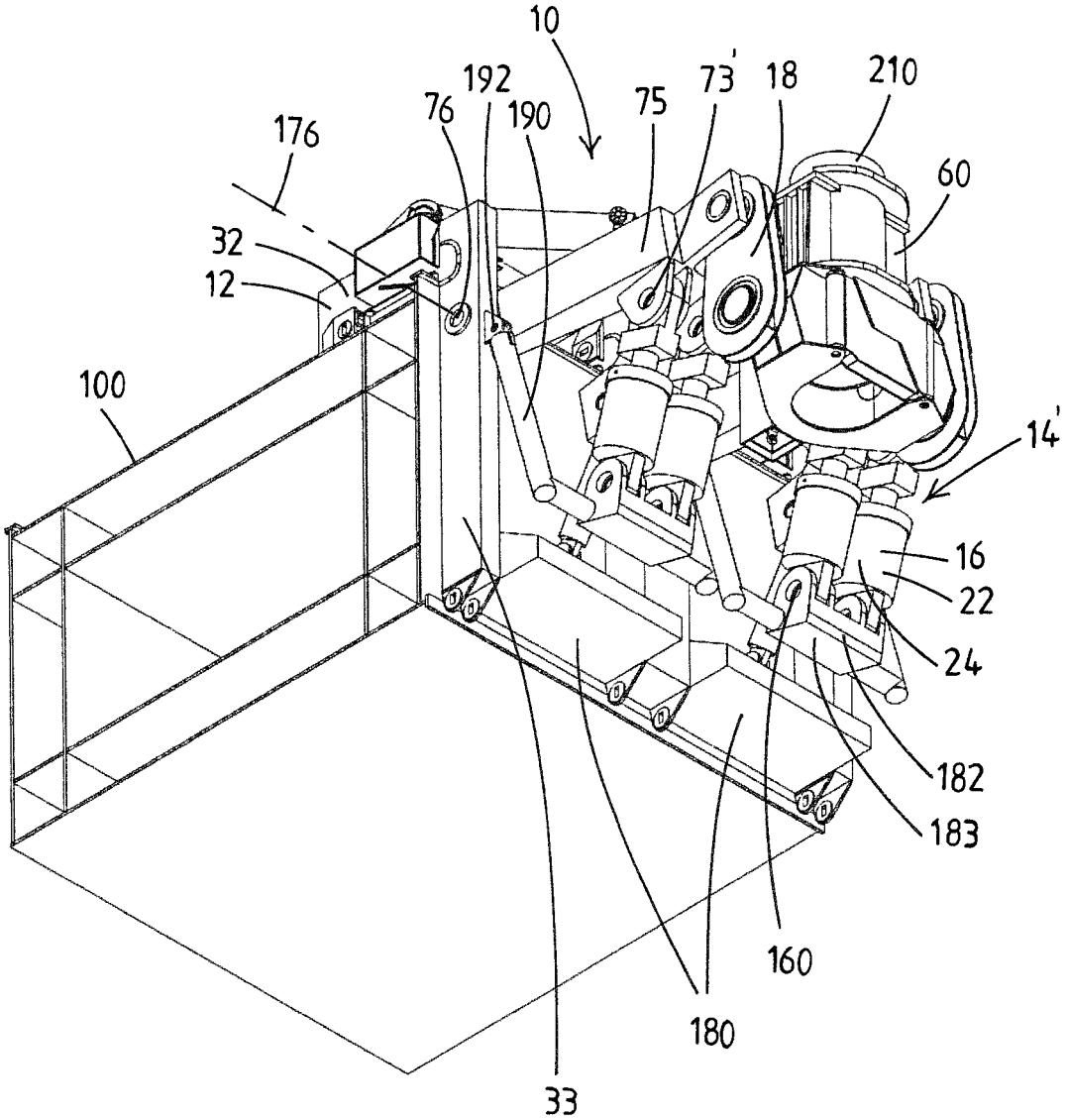
FIG. 25 shows an isometric view from below of the embodiment of FIG. 22.
Figure 26:
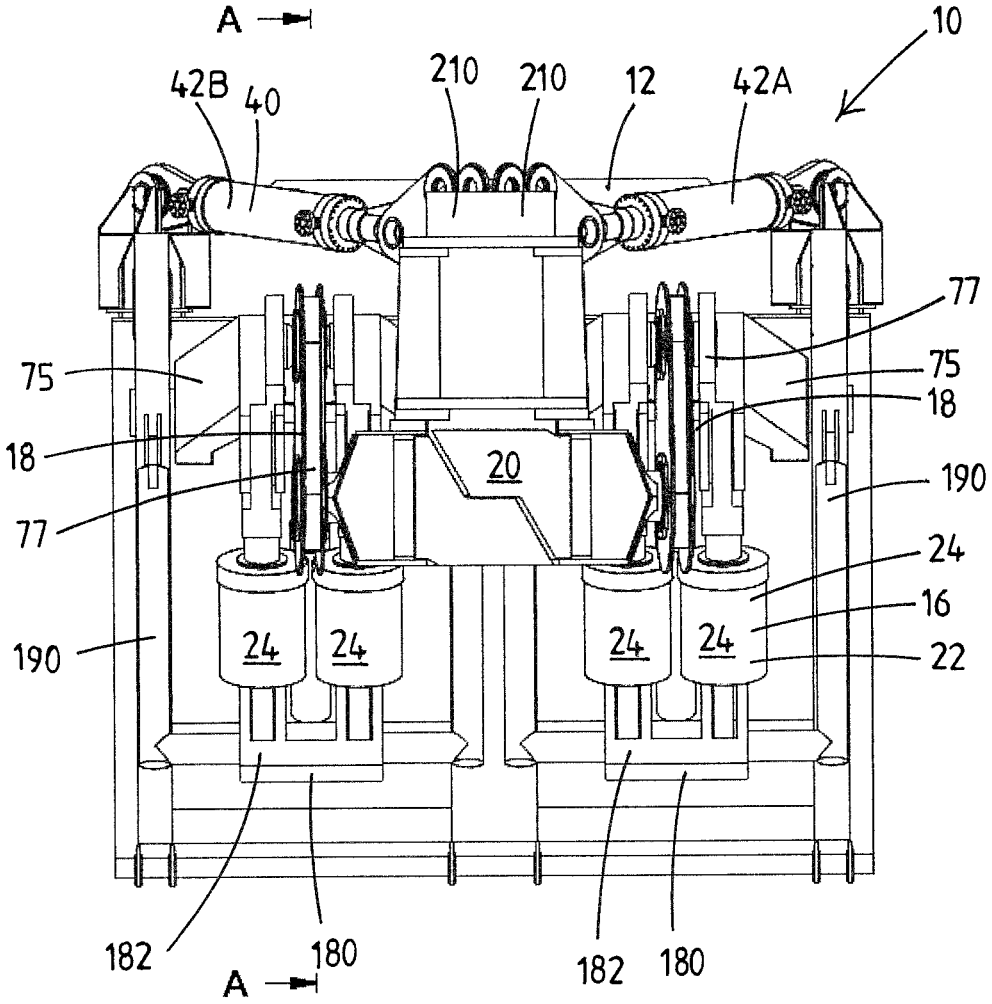
FIG. 26 shows a front view of the embodiment of FIG. 22.
Figure 27:
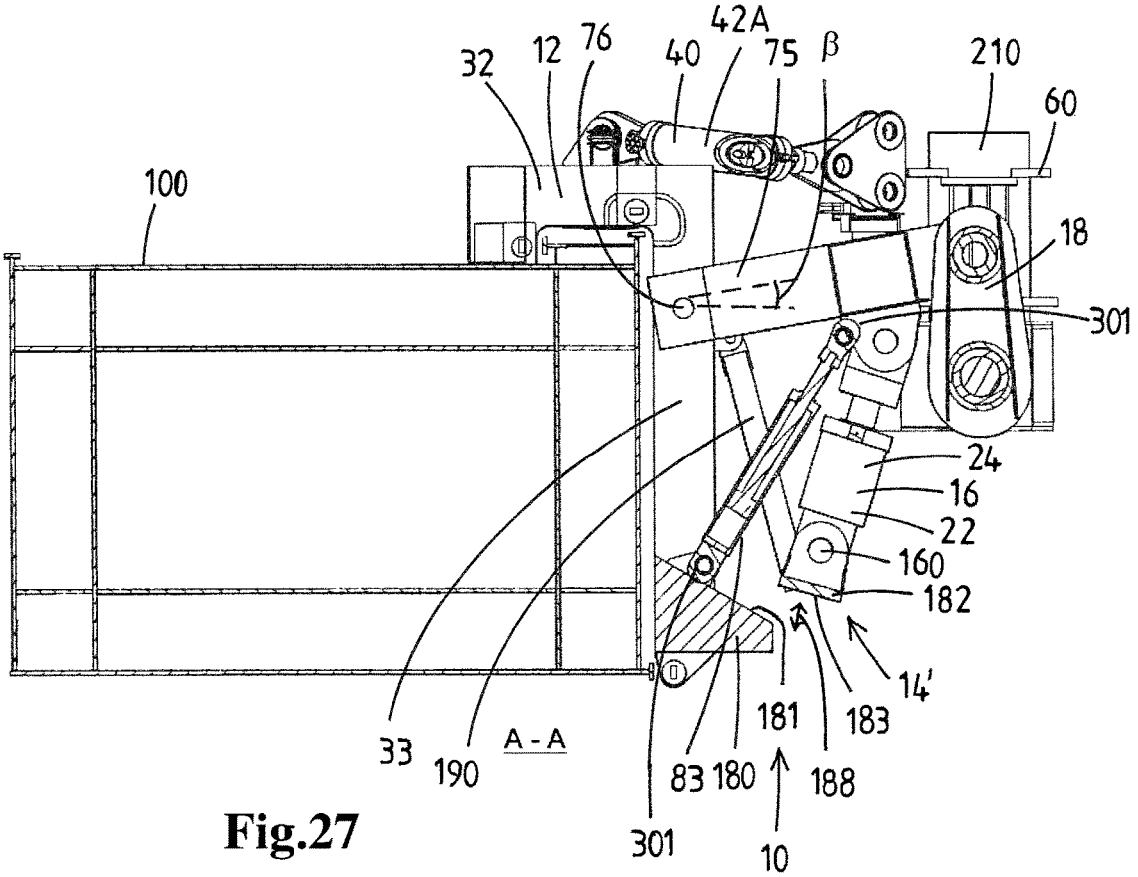
FIG. 27 shows a detailed sectional side view according the lines A-A in FIG. 26.

Turning to FIG. 16B, same or similar shim plates (or resilient elements) 152 may be provided on the upper abutment surface 52 of the leg connectors 20. This provide another option of tuning to deviant collar positions.

Operation

The operation of the entire system is discussed with reference to FIGS. 13A-13F and FIGS. 14A-14D.

Figure 14B:
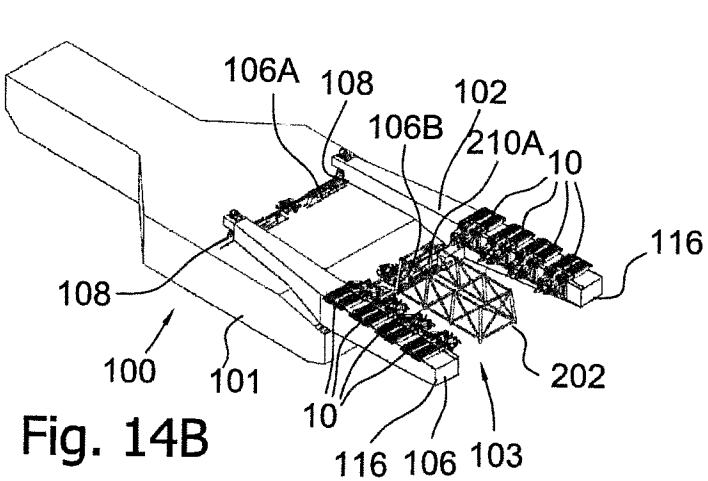
FIGS. 14A-14D show different stages of the lifting vessel in the lifting operation.
Figure 14D:
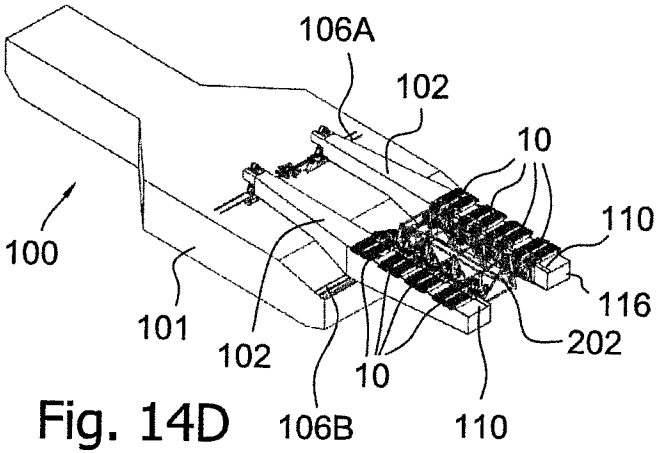
Figure 14A:
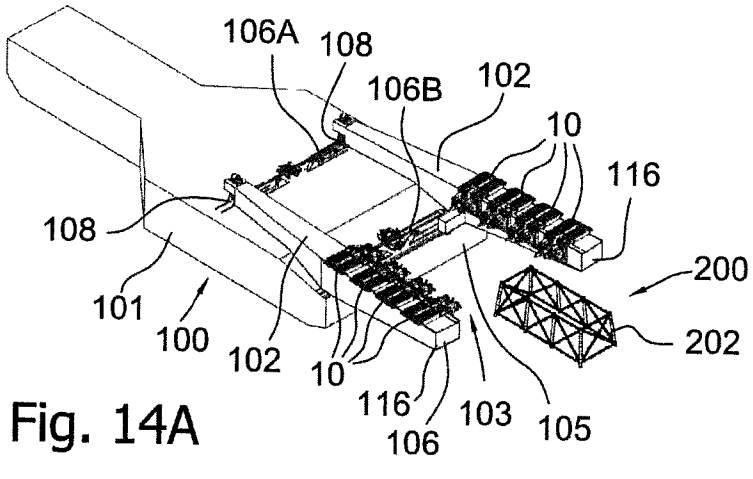

Turning in particular to FIG. 14A, the lifting vessel according to the invention is provided, and the lifting devices 10 are positioned on the lifting arms 102 in the required position to engage the legs 210 of the sea platform. The lifting devices 10 may be skidded over the skidding system 110.

The lifting vessel is positioned near the sea platform 200, and the sea platform is positioned in the docking bay 103 between the lifting arms. The method comprises a step of connecting collars 60 to the legs of the sea platform prior to the lifting operation itself. The leg connectors 20 engage the collars during the lifting step and exert the lift force on the sea platform via the collars. The collars 60 are attached to the legs above the position where the leg connectors engage the legs.

Figure 1A:
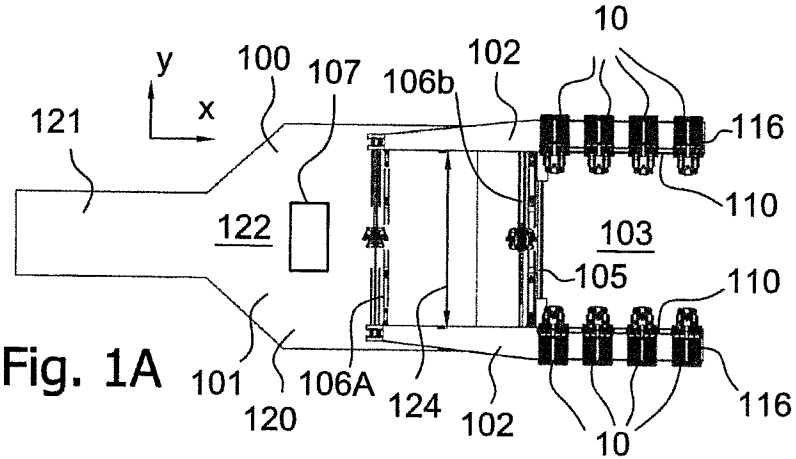
FIG. 1A shows a top view of a lifting vessel according to the invention.
Figure 1B:
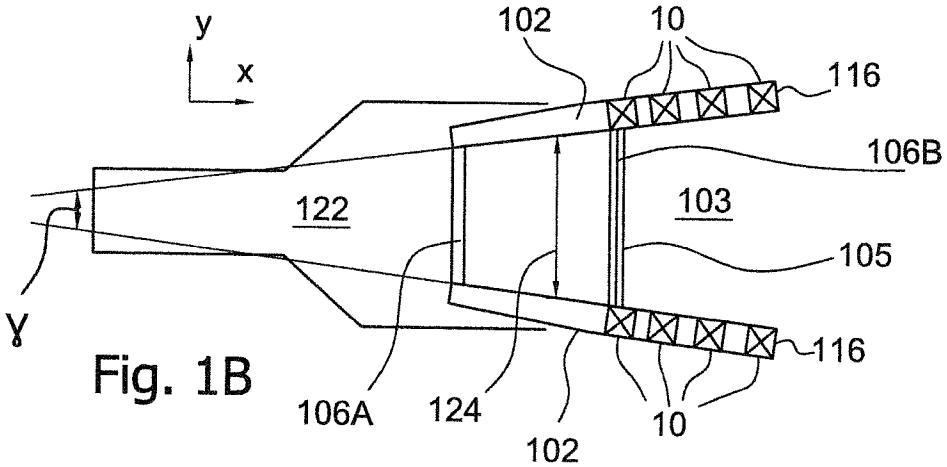
FIG. 1B shows a top view of a lifting vessel according to the invention with diverging lifting arms.
Figure 5:
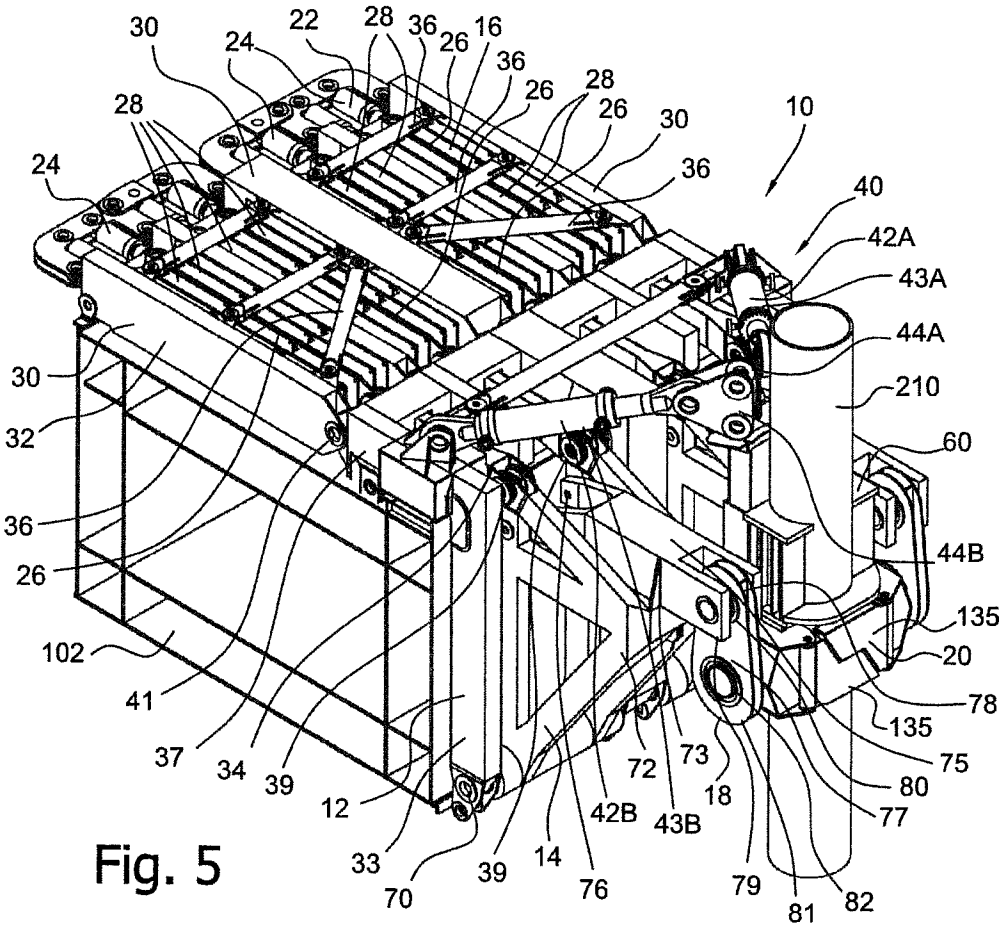
FIG. 5 shows an isometric view of a lifting device according to the invention.
Figure 6:
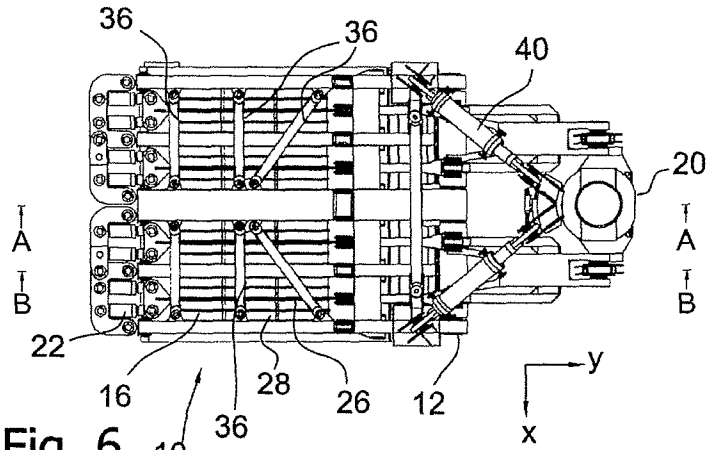
FIG. 6 shows a top view of a lifting device according to the invention.
Figure 7:
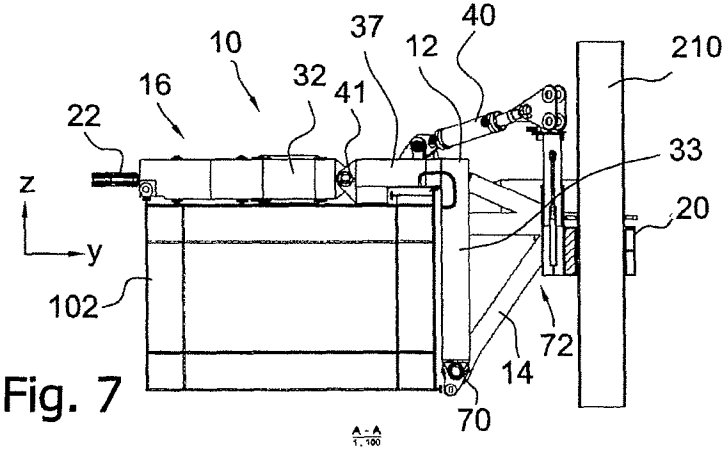
FIG. 7 shows a sectional side view of a lifting device according to the invention along the lines A-A in FIG. 6.
Figure 8:
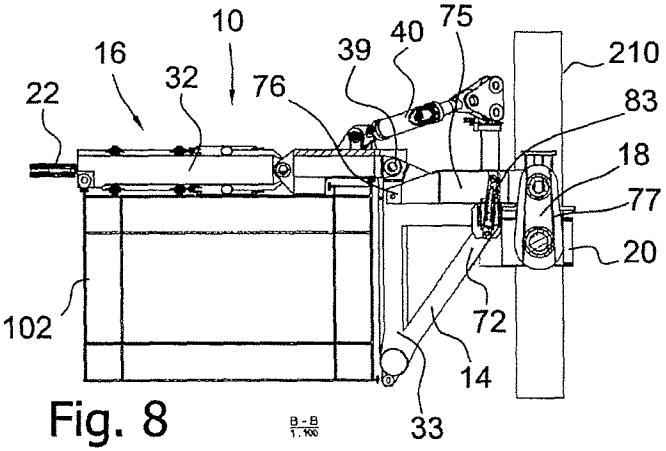
FIG. 8 shows a sectional side view of a lifting device according to the invention along the lines B-B in FIG. 6.
Figure 9:
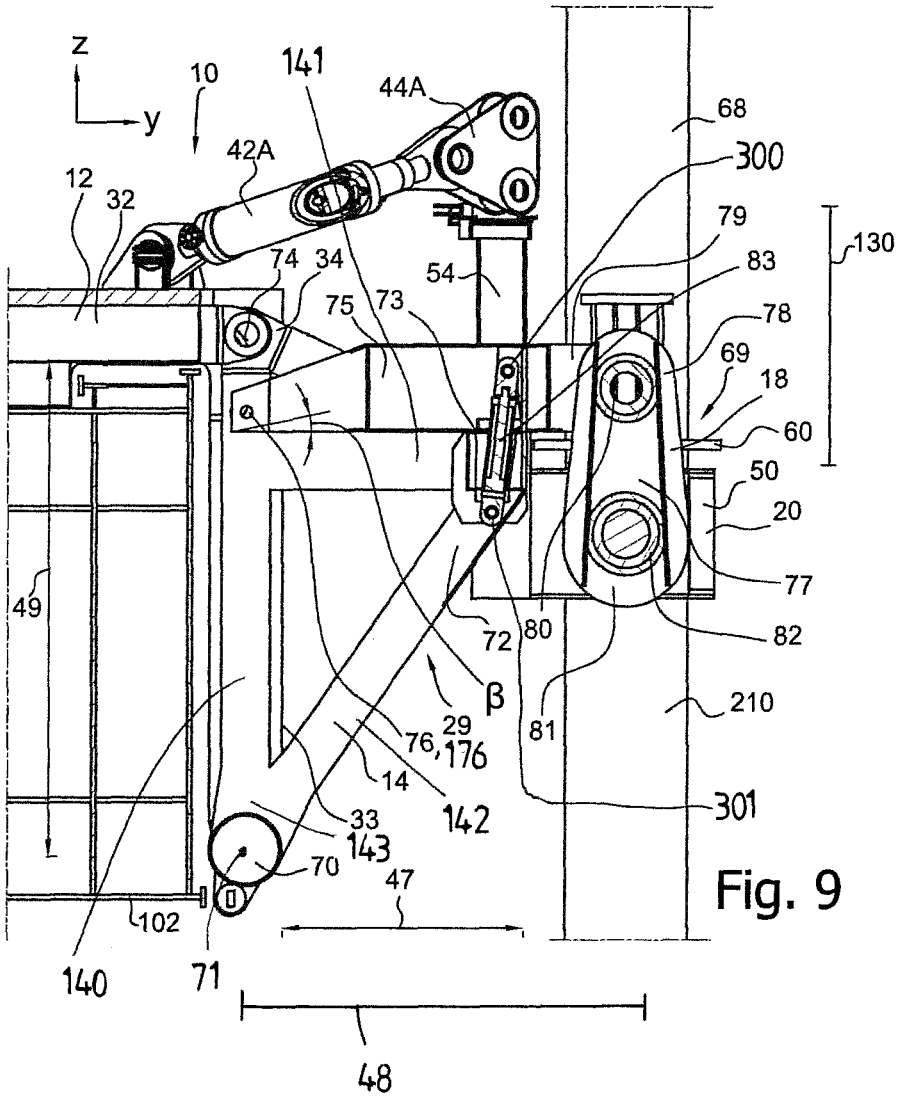
FIG. 9 shows a partial and enlarged sectional side view of a lifting device according to the invention along the lines B-B in FIG. 6.

The lifting arms may each diverge over an angle of 1-20 degrees to facilitate the positioning operation (shown in FIG. 1B). After engagement of the lifting devices 10 with the legs 210A (see FIG. 14B) which are closest to a blind end 105 of the docking bay 103, the lifting arms 102 may be pivoted to a parallel orientation about said legs, wherein subsequently the lifting devices engage one by one with the legs starting from said first leg and going in the direction of free ends 116 of the lifting arms by rotating the arms in a more parallel orientation about the first leg. An operator who controls the lifting arms 102 may control the subsequent contacting of the leg connectors by only moving one point of each lifting arm, in particular by moving a single carriage 108 of each lifting arm.

Turning to FIG. 14B, the lifting arms 102 are positioned parallel to one another, at a greater distance than a width of the sea platform. The lifting arms of the vessel extend parallel to a row of legs on one side of the sea platform and parallel to a row of legs on an opposite side of the sea platform. A blind end 105 of the docking bay is engaged with the platform, in particular via fenders.

Figure 13A:
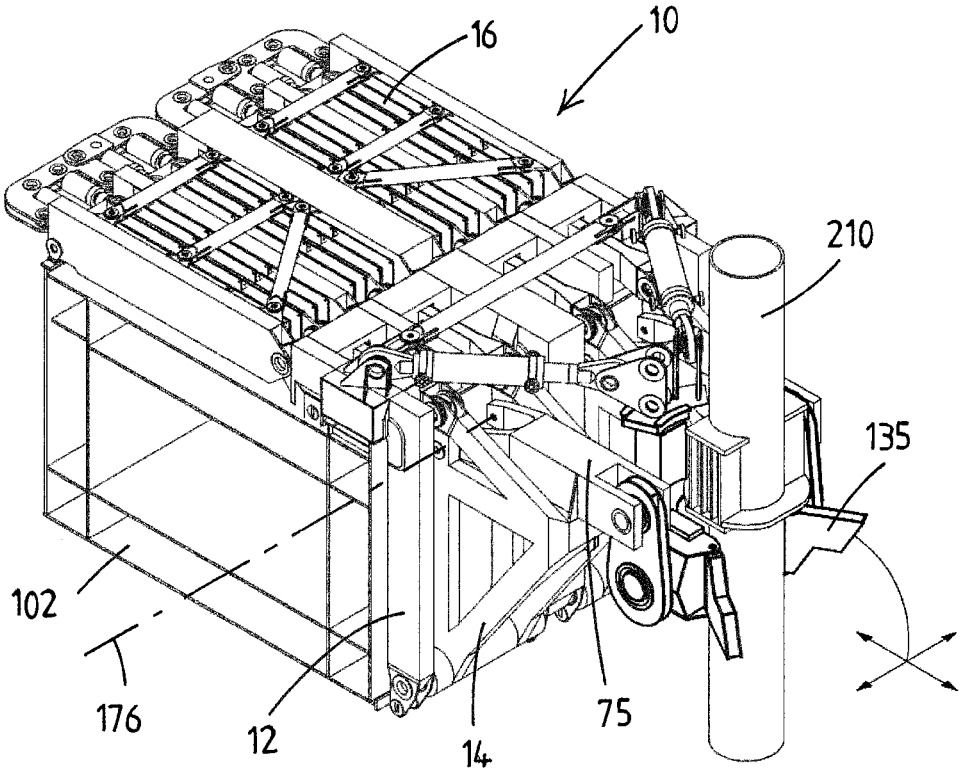
FIGS. 13A-13F show different stages of the lifting device in the lifting operation.
Figure 14C:
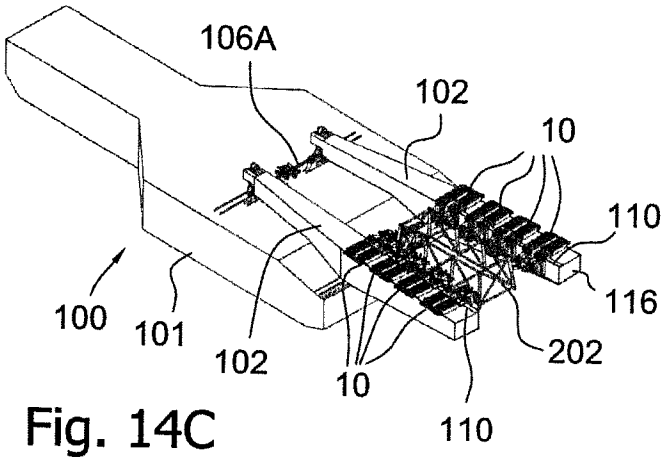

Turning to FIG. 14C, at one side of the sea platform the lifting devices 10 engage the legs 210. As is shown in FIG. 13A, in this phase the pivotable beams 75 of the lifting devices are in the lower position. The doors 135 of the leg connectors 20 are being closed around the leg 210.

Figure 13B:
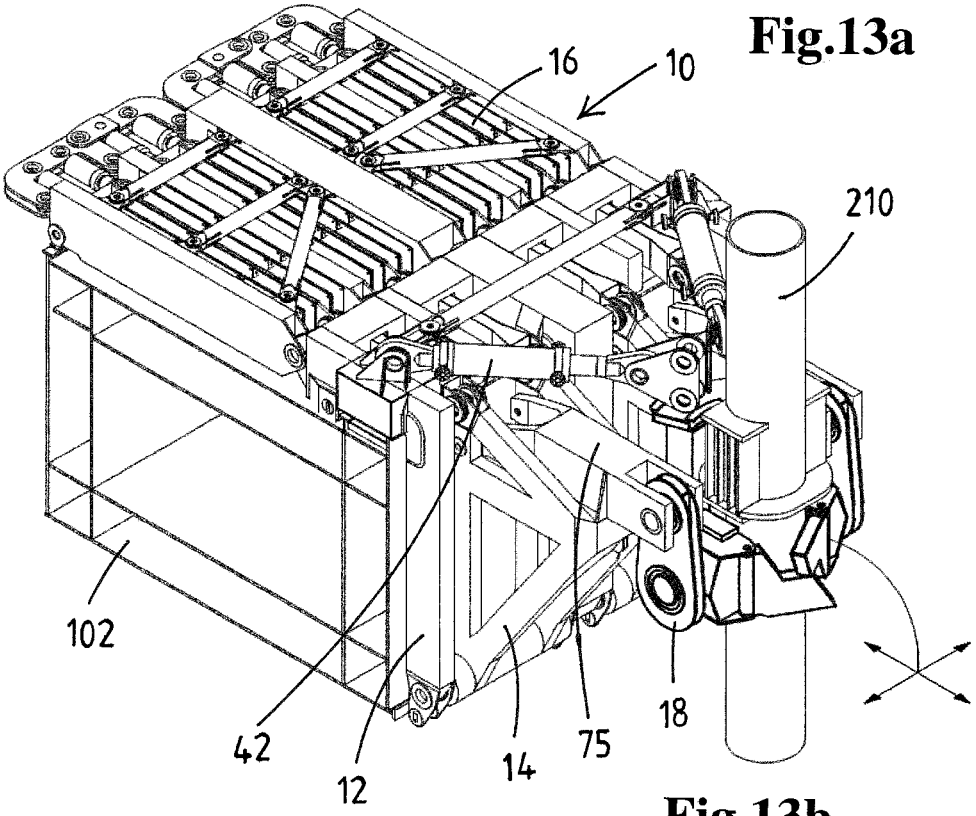

Turning to FIG. 13B, the leg connectors 20 of the lifting devices 10 are engaged with the legs 210 of the sea platform, and the doors 135 are closed.

Figure 13C:
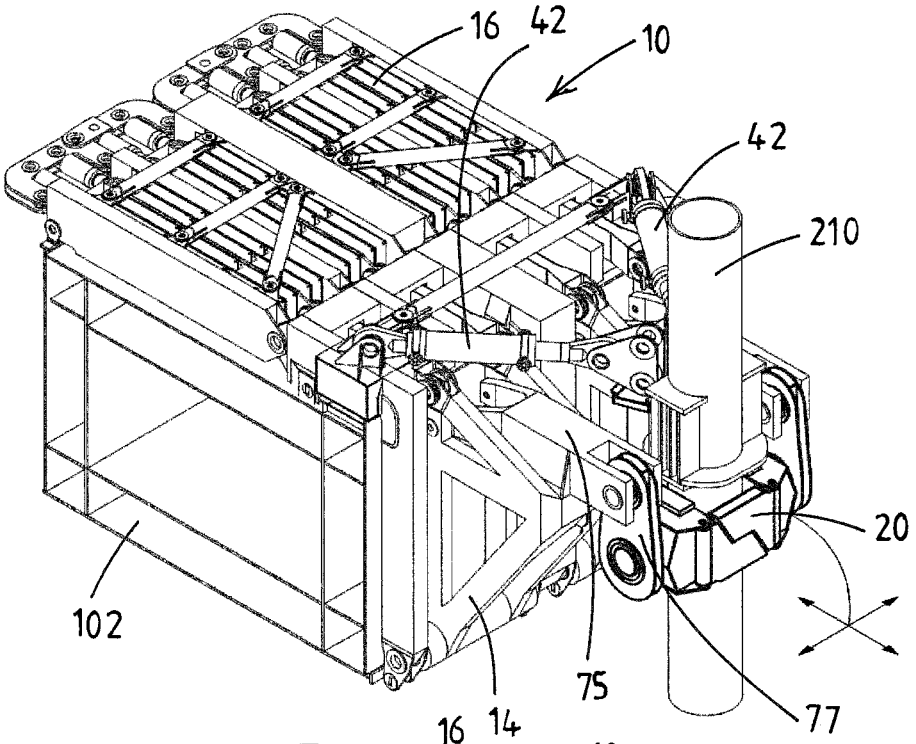

Turning to FIG. 13C, the horizontal restrainers 42 are connected to the mounting positions on the vertical post of the leg connector. In an alternative embodiment, the horizontal restrainers may be connected directly to the leg or to a separate collar which is provided on the leg above the collar 60.

Turning to FIG. 14D, the other lifting arm 102 is also positioned relative to the sea platform. The lifting devices 10 on this lifting arm also engage the respective legs 210 according to the process shown in FIGS. 13A, 13B and 13C.

Figure 13D:
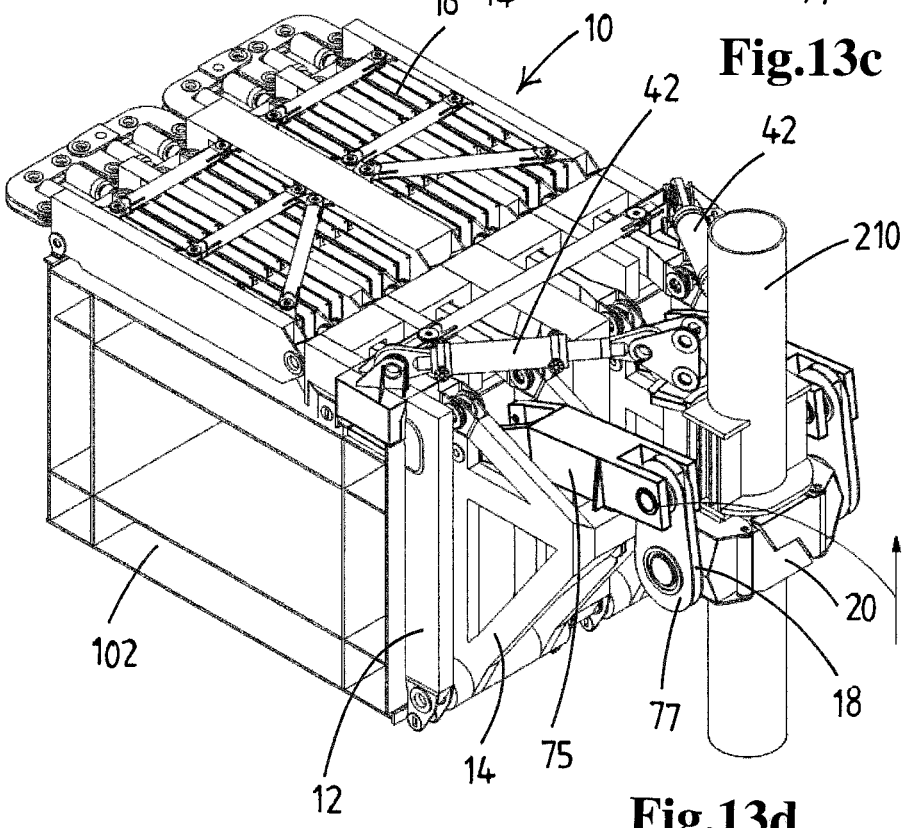

Turning to FIG. 13D, the pivotable beams 75 are pivoted upwards by the pivotable beam actuator 83 (not shown in FIG. 13D because the pivotable beam actuator 83 is underneath and partially inside the pivotable beam 75). The abutment surface 52 of the leg connector engages the abutment surface 61 of the collar 60.

Figure 13E:
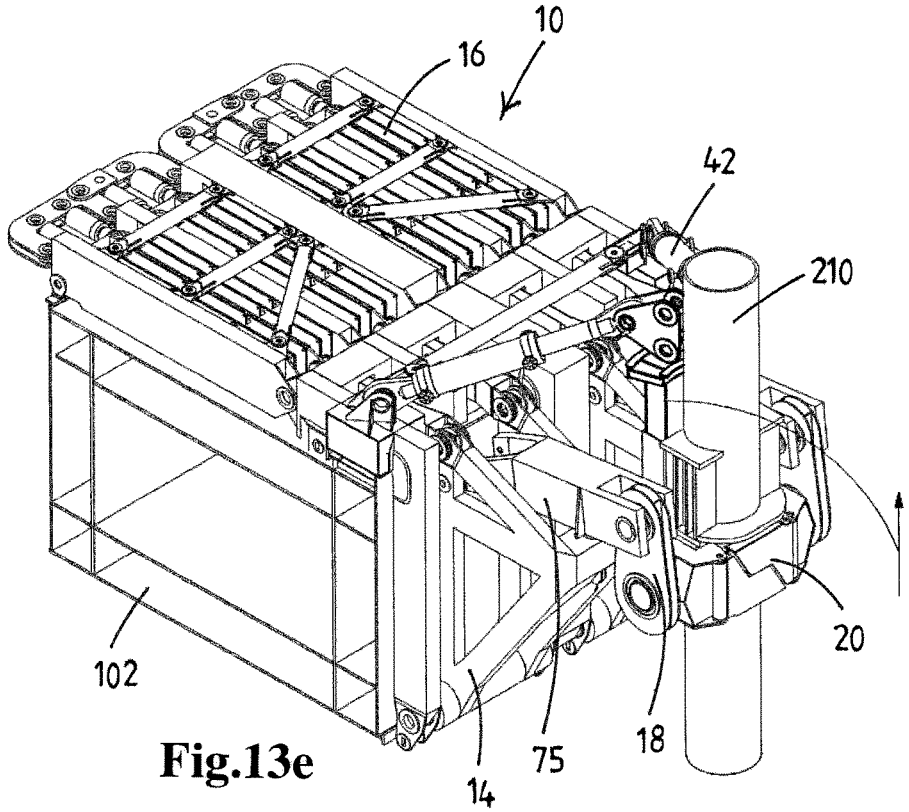

Turning to FIG. 13E, the pivotable beams have been pivoted upwards. The lifting device is now in the free-moving mode. The lifting vessel can be moved relative to the sea platform under the influence of wind and waves over a certain distance in X, Y and Z direction. There is also freedom of rotation of the lifting vessel relative to the sea platform about three axes X, Y and Z over limited angles, i.e. a freedom in yaw, pitch and heave over limited angles. The leg connectors are pre-tensioned at a predetermined pre-tension force against the collars by the pivotable beam actuator 83.

The at least one pivotable beam is in the upper position at a distance of the associated outer support and has a freedom of movement up and down relative to the outer support 73 of the console frame. When the vessel moves upwards relative to the sea platform, the pivotable beam 75 pivots downward. The pivotable beam actuator 83 provides a counterforce against the downward movement of the pivotable beam 75, but the stiffness of the pivotable beam actuator 83 is relatively low, thereby creating the freedom of movement.

The pivotable beam actuator 83 and the flexible connection system 16 are actually arranged in series, and therefore the flexible connection system 16 also contributes to the stiffness. However, the stiffness of the pivotable beam actuator 83 is much lower than the stiffness of the flexible connection system 16, so the effect of the flexible connection system 16 is quite low.

The at least one pendulum arm has a freedom of movement in at least two, in particular three degrees of freedom relative to the associated pivotable beam and the leg connector has a freedom of movement in at least two, in particular three degrees of freedom relative to the at least one pendulum arm to which it is connected.

The horizontal restrainers 42 are in a free moving mode, i.e. they are not under pressure.

Subsequently the legs 210 are cut underneath the leg connectors 20. The upper 214 part of the sea platform is now loose from the lower part 215, but still rests on the lower part. It is possible that temporary flanges are created on the legs below the position where the leg connectors engage the legs. The temporary flanges allow the legs to be cut but still held together by a bolt which interconnects the flanges. In this embodiment, after the stage shown in FIG. 13E the legs 210 are not cut (they have already been cut) but the bolts are removed.

Figure 13F:
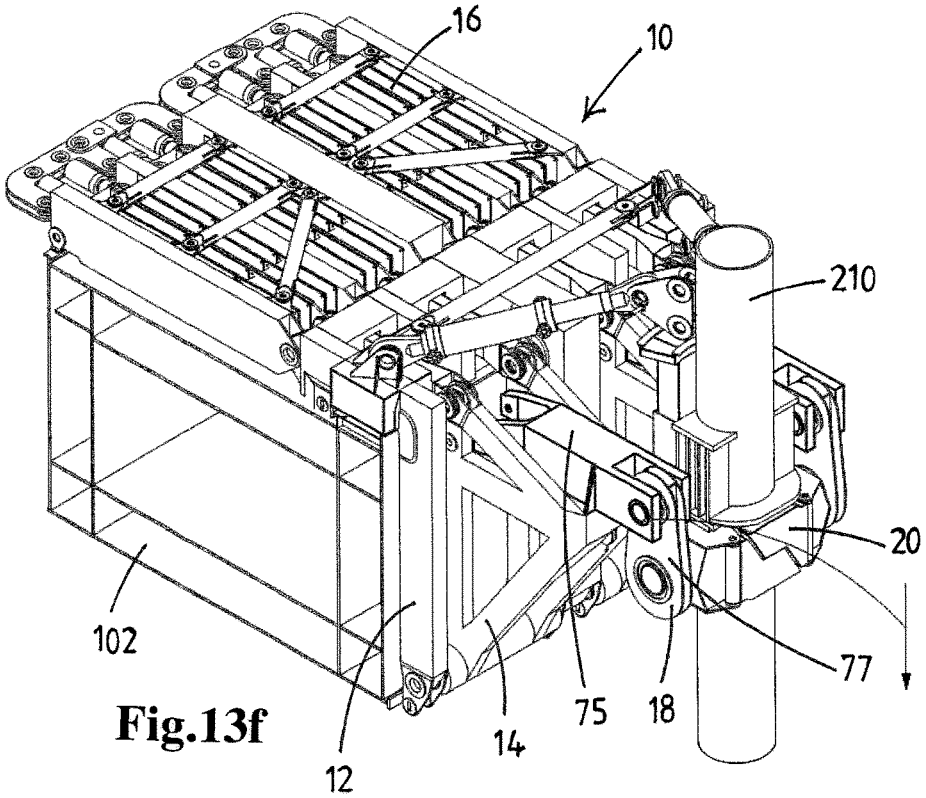

Turning to FIG. 13F, the ballasting system of the lifting vessel is emptied and the pivotable beams 75 pivot downwards and come to rest again on the outer supports as a result of the upward movement of the de-ballasted vessel. Now the actual load transfer operation begins where the full weight of the upper part of the sea platform is transferred from the lower part to the lifting devices and ultimately the lifting vessel.

A large upward force is exerted via the suspension system and the leg connectors onto the legs 210. The upper part of the sea platform is lifted from the lower part of the sea platform in a single lift. The horizontal restrainers 42 are activated and become rigid or a very stiff spring. The horizontal restrainers 42 exert a horizontal force on the vertical posts when the vertical posts move in an X-direction or Y-direction. The force exerted by the restrainers brings the leg 210 back to its neutral position. The horizontal restrainers can both push and pull the leg 210. The lifting devices 10 are now in the supporting mode. Some movement of the upper part relative to the lifting vessel is allowed via the flexible connection system, but not much.

The at least one pendulum arm on its own still has a freedom of movement in at least two, in particular three degrees of freedom relative to the associated pivotable beam. The leg connector has a freedom of movement in at least two, in particular three degrees of freedom relative to the at least one pendulum arm to which it is connected.

However, there is no vertical freedom of movement anymore between the leg and the console frame 14, because the leg 210 rests on the leg connector 20 and the pivotable beams 75 rest on the outer supports 73 of the console frame. The pivotable beam actuators 83 have become inactive. Further, there is very limited freedom of movement in a horizontal direction, because the horizontal restrainers substantially fixate a higher position of the leg in an X-direction and an Y-direction relative to the base frame.

There still is some freedom of movement between the upper part and the lifting vessel because the console frame 14 and the base frame move relative to one another via the flexible connection system 16 as is discussed above. The console frame 14 may pivot relative to the base frame over a limited angle. The stiffness of this movement is determined by the flexible connection system 16. This prevents excessive forces on the legs 210 which could otherwise lead to damage or even collapse of one of the legs. The stiffness of the flexible connection system 16 is substantially higher than the stiffness of the pivotable beam actuators 83.

The combination of the lifting vessel and upper part of the sea platform is subsequently moved away from the lower part, i.e. the substructure and may be towed to a port or sail under its own propulsion system.

Prior to making contact between the lifting vessel and the sea platform, the flexible connection systems 16 may be tuned to the specific expected loads by removing or adding or replacing resilient blocks and/or pre-tensioning the actuation system at a predetermined level. The deformation (bending and torsion) of the lifting arms 102 under the load may be taken into account, and result in different tuning settings for each lifting device 10 depending on the position on the lifting arms 102.

During the lifting operation, further tuning may be performed by adjusting the actuation system. The resilient members will generally not be changed under load.

All this time, the lifting device may be operated passively for the lift itself. The tuning requires energy, but the lift itself and the compensation of the relative movements between the upper part and the lifting vessel does not require energy.

The lifting procedure may also be reversed, i.e. lifting vessel may also be used to place an upper part of a sea platform onto a lower part.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

Second Embodiment

Turning to FIGS. 17-21, another embodiment is shown in which the pivot points 70 of the console frame 14 and the flexible connection system 16 have a different arrangement. The base frame 12 has a deck part 32 and a side part 33. The deck part 32 is relatively small in comparison with the first embodiment. It will be understood that the term "rests on" in connection with position of the base frame on the lifting vessel is to be interpreted broadly and covers all variants wherein the base frame is secured to the lifting vessel and is supported by the lifting vessel, i.e. a situation in which the base frame is secured to the side of the lifting vessel and supported in that position is also intended to be covered by the term "rests on".

The console frame has a different form than the console frame of FIGS. 1-16 and basically consists of a hinging beam 144. The hinging beam 144 has an outer support for supporting the pivotable beam in its lower position. When seen in top view (see FIG. 19), the hinging beam has a U-shape, wherein two arms 145 project outwardly from the pivot axis 71, and a bridge part 146 which comprises the outer support 73 spans the distance between the two arms and interconnects the two arms 145. Each lifting device 10 comprises two console frames 14 and two pivotable beams 75.

The flexible connection system 16 comprises one or more cylinders 24, in particular one or more hydraulic cylinders, which are located below the console frame 14. The cylinders of the flexible connection system 16 extend between a lower pivot point 160 on the side part 33 to an upper pivot point 74 on the console frame 14.

The pivot points 70 which define the pivot axis about which the console frame pivots are located higher than in the embodiment of FIGS. 5-13E. An advantage is that the movement of the suspension system 18 as a result of pivoting of the console frame 14 has a smaller horizontal component or no horizontal component at all. The pivot points 70 via which the console frame 14 is connected to the base frame are provided on the side part of the base frame and above the lower pivot points 160. The pivot points 70 may be located at a horizontal level which lies between the level of the pendulum hinges 80 and the level of the leg connector hinge 82. The pivot axis 176 of the pivotable beams and the pivot axis 71 of the console frame are relatively close to one another, i.e. at a distance of less than 10 percent of the length 48 of the pivotable beam 48, and may be coaxial.

The cylinders 24 can be operated as springs, i.e. passively, or can be operated actively with a pump. Four cylinders 24 are provided, i.e. two per pivotable beam 75. A different number is conceivable.

As an alternative the pivotable beam actuator 83 may be connected directly to the side part 33 of the base frame, i.e. the point 301 may be located on the side part 33 of the base frame 12. In the free-moving mode, the pivotable beam actuator 83 and the flexible connection system are arranged in parallel.

In this alternative, the cylinders 24 of the flexible connection system 16 may be connected directly to the pivotable beam 75 to which the pendulum arms 77 are connected, when the bottom side of the cylinder is connected to a new hingeable arm, allowing clearance between the bottom of the cylinder and the steel structure connected to the barge beam during the pretention stage.

Third Embodiment

Turning to FIGS. 22-27, a third embodiment is shown. In this embodiment, the lifting device 10 comprises a console mechanism 14' instead of a console frame. The flexible connection system (16) is a part of the console mechanism, rather than a system separate to the console frame as in the previous two embodiments.

The console mechanism 14' comprises the flexible connection system 16 which comprises at least one hydraulic actuator 24. The hydraulic actuator provides the relatively high rigidity during the supporting mode. The hydraulic actuator is connected to the pivotable beam at support point 73' via a hinge. At a lower end, the hydraulic actuator is connected to a pivotable member 190 which is connected to the base frame 12 via a hinging connection 192 which defines a horizontal pivot axis of the pivotable member 190.

The suspension system 18 is similar to the suspension system of the first and second embodiments. The base frame 12 and the horizontal restraining system 40 is also the same or very similar. The suspension system, more in particular the pivotable beam 75, is connected to the base frame 12 or to the console mechanism 14' via a hinge 76 which defines the horizontal pivot axis 176. The pivotable beam actuator 83 extends between the base frame 12 and the pivotable beam 75.

The flexible connection system 16 forms a flexible connection between the base frame 12 and the suspension system 18, in particular the pivotable beam 75, and allows a limited movement of the suspension system relative to the base frame.

The suspension system comprises at least one pivotable beam 75 which extends outwardly away from the base frame over a horizontal distance 48. The pivotable beam and is pivotable about the horizontal pivot axis relative to the base frame.

The console mechanism 14' extends outwardly away from the base frame over a horizontal distance 47 and in the supporting mode the console mechanism supports the pivotable beam at an outer support point 73' at a horizontal distance 47 from the base frame.

The lifting device is constructed to be switched from a:

free-moving mode in which the console mechanism and the flexible connection system provide a low stiffness and a low counterforce against a downward pivotal movement of the pivotable beam, to a supporting mode, wherein the console mechanism and the flexible connection system provide a high stiffness and a high counterforce against said downward pivotal movement of the pivotable beam.

The at least one pivotable beam 75 is connected to the console mechanism or to the base frame via a hinging connection 76 which allows the pivotable beam to pivot relative to the base frame between a lower position and an upper position. The console mechanism 14' is connected to the pivotable beam at the support point 73' and pivots with the pivoting movement of the pivotable beam.

The base frame 12 comprises a support base 180 having an abutment surface 181. The support base is located at a lower end of the side part of the base frame. The console mechanism 14' comprises a foot 182 having a mating support surface 183. The foot 182 engages the support base 180 when the pivotable beam 83 pivots to a lower position. As a result of the engagement, the flexible connection system 16 is activated. The flexible connection system has a relatively high stiffness, i.e. a higher stiffness than the stiffness of the pivotable beam.

In the upper position, the foot is at a distance 188 from the support base. In the upper position the pivotable beam is allowed to pivot over an angle R. The console mechanism pivots with the pivotable beam. In the upper position, the console mechanism is inactive because it cannot bear any force due to the distance 188 between the support base 180 and the foot 182. In the lower position, the foot engages the support base of the base frame and is supported by the support base.

Basically, the console mechanism and the pivotable beam actuator support the pivotable beam in parallel. In the upper position the console mechanism is inactive and the pivotable beam actuator 83 supports the pivotable beam by itself.

In the free-moving mode the pivotable beam actuator 83 holds the pivotable beam in the upper position and provides a relatively low stiffness against a downward pivotal movement of the pivotable beam.

In the supporting mode the console mechanism 14' which comprises the flexible connection system supports the pivotable beam at an outer support point 73' against a downward pivotal movement and provides a counterforce against the downward pivotal movement of the pivotable beam, the flexible connection system 16 having a relatively high stiffness in comparison with the relatively low stiffness of the pivotable beam actuator 83 and allowing a limited movement of the pivotable beam together with the console frame relative to the base frame.

The pivotable beam actuator 83 and the flexible connection system 16 are actually arranged in parallel, and therefore the pivotable beam actuator 83 also contributes to the stiffness. However, the stiffness of the pivotable beam actuator 83 is much lower than the stiffness of the flexible connection system 16, so the effect of the pivotable beam actuator 83 is quite low. In the upper position (free-moving mode) the console mechanism is inactive and the pivotable beam actuator 83 supports the pivotable beam by itself.

The terms "a" or "an", as used herein, are defined as one or more than one. The term plurality, as used herein, is defined as two or more than two. The term another, as used herein, is defined as at least a second or more. The terms including and/or having, as used herein, are defined as comprising i.e., open language, not excluding other elements or steps.

Any reference signs in the claims should not be construed as limiting the scope of the claims or the invention. It will be recognized that a specific embodiment as claimed may not achieve all of the stated objects.

The mere fact that certain measures are recited in mutually different dependent claims does not indicate that a combination of these measures cannot be used to advantage.

The invention claimed is:

1. A lifting device for lifting an upper part of a sea platform, the sea platform comprising a support structure and a top side, the lifting device being constructed to be positioned on a lifting vessel, the lifting device comprising:

a base frame constructed to rest on the lifting vessel, at least one console frame connected to the base frame via a flexible connection system, a suspension system connected to the console frame or to the base frame and comprising a leg connector which is constructed to be connected to a leg of the sea platform, wherein the suspension system is constructed to allow freedom of movement of the leg connector relative to the console frame, wherein the flexible connection system forms a flexible connection between the console frame and the base frame and allows a predetermined movement of the console frame relative to the base frame, wherein the suspension system comprises at least one pivotable beam which extends outwardly away from the base frame over a horizontal distance and is pivotable about a horizontal pivot axis relative to the base frame, wherein the lifting device comprises a pivotable beam actuator for pivoting the pivotable beam between an upper position and a lower position, wherein in the lower position the pivotable beam engages an outer support of the console frame and is supported by the console frame, and wherein in the upper position the pivotable beam is positioned at a distance above the outer support, thereby defining a gap between the pivotable beam and the outer support, and is allowed to pivot over an angle β, wherein the lifting device is constructed to be switched:

from a load-transfer mode in which the flexible connection system and the pivotable beam actuator provide a first stiffness and a first counterforce against a downward pivotal movement of the pivotable beam, to a transport mode in which the console frame and the flexible connection system provide a second stiffness and a second counterforce against the downward pivotal movement of the pivotable beam, wherein the second stiffness is greater than the first stiffness, and the second counterforce is greater than the first counterforce, and wherein in the upper position the lifting device is in the load-transfer mode, wherein in the lower position the lifting device is in the transport mode, and wherein the lifting device is configured to be switched from the load-transfer mode to the transport mode by pivoting the pivotable beam downward and engaging the outer support of the console frame, thereby closing the gap between the pivotable beam and the outer support.

2. The lifting device according to claim 1, wherein the console frame extends outwardly away from the base frame and is pivotable about a horizontal pivot axis relative to the base frame, wherein in the transport mode the console frame supports the pivotable beam at the outer support at a horizontal distance from the base frame.

3. The lifting device according to claim 1, wherein in the load-transfer mode the pivotable beam actuator is active and wherein in the transport mode the pivotable beam actuator is inactive.

4. The lifting device according to claim 1, wherein the suspension system comprises at least one pendulum arm being connected at an upper end thereof to a protruding end of the pivotable beam via a pendulum hinge, wherein the leg connector is attached to a lower end of the at least one pendulum arm via a leg connector hinge, and wherein the suspension system is constructed to allow freedom of movement of the leg connector relative to the pivotable beam.

5. The lifting device according to claim 4, wherein the lifting device is constructed to be switched between:

the load-transfer mode, in which the at least one pivotable beam is in the upper position at a distance of the outer support and has a freedom of movement up and down relative to the outer support, wherein the at least one pendulum arm has a freedom of movement in at least two degrees of freedom relative to the pivotable beam and wherein the leg connector has a freedom of movement in at least two degrees of freedom relative to the at least one pendulum arm to which it is connected, and wherein horizontal restrainers are freely movable, and the transport mode, in which the pivotable beam is in the lower position and rests on the outer support, wherein the at least one pendulum arm has a freedom of movement in at least two degrees of freedom relative to the pivotable beam and wherein the leg connector has a freedom of movement in at least two degrees of freedom relative to the at least one pendulum arm to which it is connected, and wherein the horizontal restrainers substantially fixate a higher position of the leg in an X-direction and Y-direction relative to the base frame.

6. The lifting device according to claim 1, wherein:

in the load-transfer mode the pivotable beam actuator holds the pivotable beam in the upper position and provides the first stiffness against the downward pivotal movement of the pivotable beam, and in the transport mode the console frame and the flexible connection system support the pivotable beam at the outer support against the downward pivotal movement and provide the second counterforce against the downward pivotal movement of the pivotable beam, the flexible connection system having the second stiffness greater than the first stiffness of the pivotable beam actuator and allowing a limited, predetermined, movement of the pivotable beam together with the console frame relative to the base frame.

7. The lifting device according to claim 1, wherein the flexible connection system comprises resilient members which allow the console frame to be displaced relative to the base frame over a limited angle by deformation of the resilient members.

8. The lifting device according to claim 1, wherein the base frame has a deck part and a side part which extends downwards from the deck part, wherein pivot points via which the flexible connection system acts on the base frame are provided on the side part and located lower than the deck part, and in on a lower end of the side part of the base frame.

9. The lifting device according to claim 1, comprising a horizontal restraining system for limiting a horizontal movement of the leg, wherein the suspension system is configured to exert a vertical force on the leg via the leg connector, and wherein the horizontal restraining system is separate from the horizontal pivotable beam of the suspension system and configured to exert a horizontal force on the leg.

10. The lifting device according to claim 1, wherein the console frame is formed by at least one hinging beam which extends laterally from pivot points on the base frame.

11. The lifting device according to claim 10, wherein the base frame has a deck part and a side part, wherein the flexible connection system comprises one or more cylinders, which are located below the console frame and extend between a pivot point on the side part to an upper a pivot point on the console frame.

12. The lifting device according to claim 11, wherein the pivot point via which the console frame is connected to the base frame is provided on the side part of the base frame and above the pivot point to which the one or more cylinders of the flexible connection system are connected, and wherein the pivot points are located at a horizontal level which lies between the horizontal level of a pendulum hinge of the suspension system and the horizontal level of a leg connector hinge of the suspension system.

13. The lifting device according to claim 1, comprising a positioning system for moving the leg connector relative to the base frame and positioning the leg connector relative to the leg in at least two dimensions.

14. A lifting vessel, comprising:

a hull; and two lifting arms which define a docking bay between them, wherein on each lifting arm one or more lifting devices according to claim 1 are positioned, wherein the suspension systems extend into the docking bay.

15. A method of lifting an upper part of a sea platform, which sea platform comprises a support structure and a top side, the method comprising:

providing a number of lifting devices according to claim 1, and positioning the lifting devices on lifting arms of a lifting vessel in a required position to engage legs of the sea platform, and pivoting the pivotable beams of the lifting devices to the upper position, positioning the lifting vessel near the sea platform, wherein the sea platform is positioned in a docking bay between the lifting arms, engaging the leg connectors of the lifting devices with the legs of the sea platform, cutting the legs of the support structure under the leg connectors, thereby dividing the sea platform in an upper part and a lower part, de-ballasting the lifting vessel, wherein the pivotable beams pivot from the upper position to the lower position and engage the respective outer support of the console frame or a console mechanism, and lifting the upper part of the sea platform from the lower part, and moving the combination of the lifting vessel and sea platform away from the lower part.

16. The method according to claim 15, comprising a step of connecting collars to the legs of the sea platform, wherein the leg connectors engage the collars during the lifting step and exert a lift force on the sea platform via the collars.

17. The method according to claim 15, comprising:

engaging the legs with the leg connectors, moving the leg connectors upwardly against collars on the legs, by pivoting the pivotable beams upwards, wherein the lifting devices of the lifting vessel are brought in the load-transfer mode, in which the leg connectors are relatively free to move relative to the base frame, and in which horizontal restrainers are free to move and do not support the legs, after engaging with the legs, switching to the transport mode, by de-ballasting the lifting vessel, wherein the pivotable beams are moved to the lower position and engage the outer supports of the console frame, wherein at least one pendulum arm of the suspension system has a freedom of movement in at least two directions, and wherein the horizontal restrainers support the legs in a horizontal X-direction and Y-direction.

18. A lifting device for lifting an upper part of a sea platform, the sea platform comprising a support structure and a top side, the lifting device being constructed to be positioned on a lifting vessel, the lifting device comprising:

a base frame constructed to rest on the lifting vessel, at least one console mechanism comprising a flexible connection system, wherein the console mechanism extends outwardly away from the base frame over a horizontal distance, a suspension system connected to the console mechanism or to the base frame and comprising a leg connector which is constructed to be connected to a leg of the sea platform, wherein the suspension system is constructed to allow freedom of movement of the leg connector relative to the console mechanism, wherein the suspension system comprises at least one pivotable beam which extends outwardly away from the base frame over a horizontal distance and is pivotable about a horizontal pivot axis relative to the base frame, wherein the at least one pivotable beam is connected to the console mechanism or to the base frame, wherein the console mechanism is connected to the pivotable beam at an outer support point and pivots with a pivoting movement of the pivotable beam, and wherein the lifting device comprises a pivotable beam actuator for pivoting the pivotable beam between an upper position and a lower position, wherein the lifting device is constructed to be switched:

from a load-transfer mode in which the lifting device provides a first stiffness and a first counterforce against a downward pivotal movement of the suspension system, wherein in the load-transfer mode the pivotable beam actuator holds the pivotable beam in the upper position and provides the first stiffness and the first counterforce against the downward pivotal movement of the pivotable beam, to a transport mode, in which the pivotable beam is in the lower position, wherein the lifting device provides a second stiffness and a second counterforce against the downward pivotal movement of the suspension system, wherein the second stiffness is greater than the first stiffness, and the second counterforce is greater than the first counterforce, and wherein in the transport mode the flexible connection system forms a flexible connection between the base frame and the suspension system and the console mechanism supports the pivotable beam at the outer support point at a horizontal distance from the base frame against the downward pivotal movement and provides the second stiffness and the second counterforce against the downward pivotal movement of the pivotable beam in comparison with the first stiffness of the pivotable beam actuator and allows a limited movement of the pivotable beam together with the console mechanism relative to the base frame, wherein the base frame comprises a support base having an abutment surface, wherein the console mechanism comprises a foot having a mating support surface, wherein in the upper position of the pivotable beam the foot is positioned at a distance above the support base, thereby defining a gap between the pivotable beam and the support base, and the pivotable beam is allowed to pivot over an angle $\beta$, wherein in the upper position of the pivotable beam the lifting device is in the load-transfer mode, and wherein the foot engages the support base when the pivotable beam pivots to a lower position, thereby closing the gap between the pivotable beam and the support base, and wherein the flexible connection system is activated by an engagement device and the lifting device is switched to the transport mode.

19. The lifting device according to claim 18, wherein the suspension system comprises at least one pendulum arm being connected at an upper end thereof to a protruding end of the pivotable beam via a pendulum hinge, wherein the leg connector is attached to a lower end of the at least one pendulum arm via a leg connector hinge, wherein the suspension system is constructed to allow freedom of movement of the leg connector relative to the pivotable beam.

* * * * *